US009722308B2

(12) United States Patent
Emerick et al.

(10) Patent No.: US 9,722,308 B2
(45) Date of Patent: Aug. 1, 2017

(54) LOW PASSIVE INTERMODULATION DISTRIBUTED ANTENNA SYSTEM FOR MULTIPLE-INPUT MULTIPLE-OUTPUT SYSTEMS AND METHODS OF USE

(71) Applicant: Pulse Finland OY, Kempele (FI)

(72) Inventors: Curtis Emerick, San Diego, CA (US); Jaakko Takanen, San Diego, CA (US)

(73) Assignee: PULSE FINLAND OY, Oulunsalo (FI)

( * ) Notice: Subject to any disclaimer, the term of this patent is extended or adjusted under 35 U.S.C. 154(b) by 162 days.

(21) Appl. No.: 14/472,170

(22) Filed: Aug. 28, 2014

(65) Prior Publication Data

US 2016/0064813 A1 Mar. 3, 2016

(51) Int. Cl.

| | |
|---|---|
| ***H01Q 1/52*** | (2006.01) |
| ***H01Q 1/48*** | (2006.01) |
| ***H01Q 21/28*** | (2006.01) |

(52) U.S. Cl.

CPC ..... *H01Q 1/521* (2013.01); *H01Q 1/48* (2013.01); *H01Q 1/526* (2013.01); *H01Q 21/28* (2013.01)

(58) Field of Classification Search

CPC ..... H01Q 1/521
USPC ..... 343/841
See application file for complete search history.

(56) References Cited

U.S. PATENT DOCUMENTS

| | | | |
|---|---|---|---|
| 2,745,102 | A | 5/1956 | Norgorden |
| 3,938,161 | A | 2/1976 | Sanford |
| 4,004,228 | A | 1/1977 | Mullett |
| 4,028,652 | A | 6/1977 | Wakino et al. |
| 4,031,468 | A | 6/1977 | Ziebell et al. |
| 4,054,874 | A | 10/1977 | Oltman |
| 4,069,483 | A | 1/1978 | Kaloi |
| 4,123,756 | A | 10/1978 | Nagata et al. |
| 4,123,758 | A | 10/1978 | Shibano et al. |
| 4,131,893 | A | 12/1978 | Munson et al. |
| 4,201,960 | A | 5/1980 | Skutta et al. |
| 4,255,729 | A | 3/1981 | Fukasawa et al. |
| 4,313,121 | A | 1/1982 | Campbell et al. |

(Continued)

FOREIGN PATENT DOCUMENTS

| | | |
|---|---|---|
| CN | 1316797 | 10/2007 |
| DE | 10104862 | 8/2002 |

(Continued)

OTHER PUBLICATIONS

"An Adaptive Microstrip Patch Antenna for Use in Portable Transceivers", Rostbakken et al., Vehicular Technology Conference, 1996, Mobile Technology for the Human Race, pp. 339-343.

(Continued)

*Primary Examiner* — Graham Smith
(74) *Attorney, Agent, or Firm* — Gazdzinski & Associates, PC

(57) ABSTRACT

Low passive intermodulation (PIM) antenna assemblies and methods for utilizing the same. In one embodiment, the low PIM antenna assemblies described herein offer the lowest PIM level for the DAS antenna as compared with current PIM solutions currently available in the market place as well as the improvement of isolation between the radiating elements using inserted isolation rings as well as a more omni-directional radiation pattern using the insertion of slots into the radiating elements themselves. Methods of manufacturing and using the aforementioned low PIM antenna assembly are also disclosed.

20 Claims, 12 Drawing Sheets

(56) References Cited

U.S. PATENT DOCUMENTS 4,356,492 A 10/1982 Kaloi
4,370,657 A 1/1983 Kaloi
4,423,396 A 12/1983 Makimoto et al.
4,431,977 A 2/1984 Sokola et al.
4,546,357 A 10/1985 Laughon et al.
4,559,508 A 12/1985 Nishikawa et al.
4,625,212 A 11/1986 Oda et al.
4,652,889 A 3/1987 Bizouard et al.
4,661,992 A 4/1987 Garay et al.
4,692,726 A 9/1987 Green et al.
4,703,291 A 10/1987 Nishikawa et al.
4,706,050 A 11/1987 Andrews
4,716,391 A 12/1987 Moutrie et al.
4,740,765 A 4/1988 Ishikawa et al.
4,742,562 A 5/1988 Kommrusch
4,761,624 A 8/1988 Igarashi et al.
4,800,348 A 1/1989 Rosar et al.
4,800,392 A 1/1989 Garay et al.
4,821,006 A 4/1989 Ishikawa et al.
4,823,098 A 4/1989 DeMuro et al.
4,827,266 A 5/1989 Sato et al.
4,829,274 A 5/1989 Green et al.
4,835,538 A 5/1989 McKenna et al.
4,835,541 A 5/1989 Johnson et al.
4,862,181 A 8/1989 PonceDeLeon et al.
4,879,533 A 11/1989 De Muro et al.
4,896,124 A 1/1990 Schwent
4,907,006 A 3/1990 Nishikawa et al.
4,954,796 A 9/1990 Green et al.
4,965,537 A 10/1990 Kommrusch
4,977,383 A 12/1990 Niiranen
4,980,694 A 12/1990 Hines
5,016,020 A 5/1991 Simpson
5,017,932 A 5/1991 Ushiyama et al.
5,043,738 A 8/1991 Shapiro et al.
5,047,739 A 9/1991 Kuokkanene
5,053,786 A 10/1991 Silverman et al.
5,057,847 A 10/1991 Vaeisaenen
5,061,939 A 10/1991 Nakase
5,097,236 A 3/1992 Wakino et al.
5,103,197 A 4/1992 Turunen
5,109,536 A 4/1992 Kommrusch
5,155,493 A 10/1992 Thursby et al.
5,157,363 A 10/1992 Puurunen
5,159,303 A 10/1992 Flink
5,166,697 A 11/1992 Viladevall et al.
5,170,173 A 12/1992 Krenz et al.
5,203,021 A 4/1993 Repplinger et al.
5,210,510 A 5/1993 Karsikas
5,210,542 A 5/1993 Pett et al.
5,220,335 A 6/1993 Huang
5,229,777 A 7/1993 Doyle
5,239,279 A 8/1993 Turunen
5,278,528 A 1/1994 Turunen
5,281,326 A 1/1994 Galla
5,298,873 A 3/1994 Ala-Kojola
5,302,924 A 4/1994 Jantunen
5,304,968 A 4/1994 Ohtonen
5,307,036 A 4/1994 Turunen
5,319,328 A 6/1994 Turunen
5,349,315 A 9/1994 Ala-Kojola
5,349,700 A 9/1994 Parker
5,351,023 A 9/1994 Niiranen
5,354,463 A 10/1994 Turunen
5,355,142 A 10/1994 Marshall et al.
5,357,262 A 10/1994 Blaese
5,363,114 A 11/1994 Shoemaker
5,369,782 A 11/1994 Kawano et al.
5,382,959 A 1/1995 Pett et al.
5,386,214 A 1/1995 Sugawara
5,387,886 A 2/1995 Takalo
5,394,162 A 2/1995 Korovesis et al.
RE34,898 E 4/1995 Turunen
5,408,206 A 4/1995 Turunen
5,418,508 A 5/1995 Puurunen
5,432,489 A 7/1995 Yrjola
5,438,697 A 8/1995 Fowler et al.
5,440,315 A 8/1995 Wright et al.
5,442,280 A 8/1995 Baudart
5,442,366 A 8/1995 Sanford
5,444,453 A 8/1995 Lalezari
5,467,065 A 11/1995 Turunen
5,473,295 A 12/1995 Turunen
5,506,554 A 4/1996 Ala-Kojola
5,508,668 A 4/1996 Prokkola
5,510,802 A 4/1996 Tsuru et al.
5,517,683 A 5/1996 Collett et al.
5,521,561 A 5/1996 Yrjola
5,526,003 A 6/1996 Ogawa et al.
5,532,703 A 7/1996 Stephens et al.
5,541,560 A 7/1996 Turunen
5,541,617 A 7/1996 Connolly et al.
5,543,764 A 8/1996 Turunen
5,550,519 A 8/1996 Korpela
5,557,287 A 9/1996 Pottala et al.
5,557,292 A 9/1996 Nygren et al.
5,566,441 A 10/1996 Marsh et al.
5,570,071 A 10/1996 Ervasti
5,585,771 A 12/1996 Ervasti
5,585,810 A 12/1996 Tsuru et al.
5,589,844 A 12/1996 Belcher et al.
5,594,395 A 1/1997 Niiranen
5,604,471 A 2/1997 Rattila
5,627,502 A 5/1997 Ervasti
5,649,316 A 7/1997 Prodhomme et al.
5,668,561 A 9/1997 Perrotta et al.
5,675,301 A 10/1997 Nappa
5,689,221 A 11/1997 Niiranen
5,694,135 A 12/1997 Dikun et al.
5,696,517 A 12/1997 Kawahata et al.
5,703,600 A 12/1997 Burrell et al.
5,709,832 A 1/1998 Hayes et al.
5,711,014 A 1/1998 Crowley et al.
5,717,368 A 2/1998 Niiranen
5,731,749 A 3/1998 Yrjola
5,734,305 A 3/1998 Ervasti
5,734,350 A 3/1998 Deming et al.
5,734,351 A 3/1998 Ojantakanen
5,739,735 A 4/1998 Pyykko
5,742,259 A 4/1998 Annamaa
5,757,327 A 5/1998 Yajima et al.
5,760,746 A 6/1998 Kawahata
5,764,190 A 6/1998 Murch et al.
5,767,809 A 6/1998 Chuang et al.
5,768,217 A 6/1998 Sonoda et al.
5,777,581 A 7/1998 Lilly et al.
5,777,585 A 7/1998 Tsuda et al.
5,793,269 A 8/1998 Ervasti
5,797,084 A 8/1998 Tsuru et al.
5,812,094 A 9/1998 Maldonado
5,815,048 A 9/1998 Ala-Kojola
5,822,705 A 10/1998 Lehtola
5,852,421 A 12/1998 Maldonado
5,861,854 A 1/1999 Kawahata et al.
5,864,318 A 1/1999 Cosenza et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.
5,903,820 A 5/1999 Hagstrom
5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Tadahiko et al.
5,943,016 A 8/1999 Snyder, Jr. et al.
5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.

(56) References Cited

U.S. PATENT DOCUMENTS

| | | | |
|---|---|---|---|
| 5,990,848 | A | 11/1999 | Annamaa |
| 5,999,132 | A | 12/1999 | Kitchener et al. |
| 6,005,529 | A | 12/1999 | Hutchinson |
| 6,006,419 | A | 12/1999 | Vandendolder et al. |
| 6,008,764 | A | 12/1999 | Ollikainen |
| 6,009,311 | A | 12/1999 | Killion et al. |
| 6,014,106 | A | 1/2000 | Annamaa |
| 6,016,130 | A | 1/2000 | Annamaa |
| 6,023,608 | A | 2/2000 | Yrjola |
| 6,031,496 | A | 2/2000 | Kuittinen et al. |
| 6,034,637 | A | 3/2000 | McCoy et al. |
| 6,037,848 | A | 3/2000 | Alila |
| 6,043,780 | A | 3/2000 | Funk et al. |
| 6,052,096 | A | 4/2000 | Tsuru et al. |
| 6,072,434 | A | 6/2000 | Papatheodorou |
| 6,078,231 | A | 6/2000 | Pelkonen |
| 6,091,363 | A | 7/2000 | Komatsu et al. |
| 6,091,365 | A | 7/2000 | Derneryd et al. |
| 6,097,345 | A | 8/2000 | Walton |
| 6,100,849 | A | 8/2000 | Tsubaki et al. |
| 6,112,106 | A | 8/2000 | Crowley et al. |
| 6,121,931 | A | 9/2000 | Levi et al. |
| 6,133,879 | A | 10/2000 | Grangeat et al. |
| 6,134,421 | A | 10/2000 | Lee et al. |
| 6,140,966 | A | 10/2000 | Pankinaho |
| 6,140,973 | A | 10/2000 | Annamaa |
| 6,147,650 | A | 11/2000 | Kawahata et al. |
| 6,157,819 | A | 12/2000 | Vuokko |
| 6,177,908 | B1 | 1/2001 | Kawahata |
| 6,185,434 | B1 | 2/2001 | Hagstrom |
| 6,190,942 | B1 | 2/2001 | Wilm et al. |
| 6,195,049 | B1 | 2/2001 | Kim et al. |
| 6,204,826 | B1 | 3/2001 | Rutkowski et al. |
| 6,215,376 | B1 | 4/2001 | Hagstrom |
| 6,218,989 | B1 | 4/2001 | Schneider et al. |
| 6,246,368 | B1 | 6/2001 | Deming et al. |
| 6,252,552 | B1 | 6/2001 | Tarvas et al. |
| 6,252,554 | B1 | 6/2001 | Isohatala |
| 6,255,994 | B1 | 7/2001 | Saito |
| 6,268,831 | B1 | 7/2001 | Sanford |
| 6,281,848 | B1 | 8/2001 | Nagumo et al. |
| 6,295,029 | B1 | 9/2001 | Chen et al. |
| 6,297,776 | B1 | 10/2001 | Pankinaho |
| 6,304,220 | B1 | 10/2001 | Herve et al. |
| 6,308,720 | B1 | 10/2001 | Modi |
| 6,316,975 | B1 | 11/2001 | O'Toole et al. |
| 6,323,811 | B1 | 11/2001 | Tsubaki |
| 6,326,921 | B1 | 12/2001 | Egorov et al. |
| 6,337,663 | B1 | 1/2002 | Chi-Minh |
| 6,340,954 | B1 | 1/2002 | Annamaa et al. |
| 6,342,859 | B1 | 1/2002 | Kurz et al. |
| 6,343,208 | B1 | 1/2002 | Ying |
| 6,346,914 | B1 | 2/2002 | Annamaa |
| 6,348,892 | B1 | 2/2002 | Annamaa |
| 6,353,443 | B1 | 3/2002 | Ying |
| 6,366,243 | B1 | 4/2002 | Isohatala |
| 6,377,827 | B1 | 4/2002 | Rydbeck |
| 6,380,905 | B1 | 4/2002 | Annamaa |
| 6,396,444 | B1 | 5/2002 | Goward |
| 6,404,394 | B1 | 6/2002 | Hill |
| 6,417,813 | B1 | 7/2002 | Durham et al. |
| 6,421,014 | B1 | 7/2002 | Sanad |
| 6,423,915 | B1 | 7/2002 | Winter |
| 6,429,818 | B1 | 8/2002 | Johnson et al. |
| 6,452,551 | B1 | 9/2002 | Chen |
| 6,452,558 | B1 | 9/2002 | Saitou et al. |
| 6,456,249 | B1 | 9/2002 | Johnson et al. |
| 6,459,413 | B1 | 10/2002 | Tseng et al. |
| 6,462,716 | B1 | 10/2002 | Kushihi |
| 6,469,673 | B2 | 10/2002 | Kaiponen |
| 6,473,056 | B2 | 10/2002 | Annamaa |
| 6,476,767 | B2 | 11/2002 | Aoyama et al. |
| 6,476,769 | B1 | 11/2002 | Lehtola |
| 6,480,155 | B1 | 11/2002 | Eggleston |
| 6,483,462 | B2 | 11/2002 | Weinberger |
| 6,498,586 | B2 | 12/2002 | Pankinaho |
| 6,501,425 | B1 | 12/2002 | Nagumo |
| 6,515,625 | B1 | 2/2003 | Johnson |
| 6,518,925 | B1 | 2/2003 | Annamaa |
| 6,529,168 | B2 | 3/2003 | Mikkola |
| 6,529,749 | B1 | 3/2003 | Hayes et al. |
| 6,535,170 | B2 | 3/2003 | Sawamura et al. |
| 6,538,604 | B1 | 3/2003 | Isohatala |
| 6,538,607 | B2 | 3/2003 | Bama |
| 6,542,050 | B1 | 4/2003 | Arai et al. |
| 6,549,167 | B1 | 4/2003 | Yoon |
| 6,552,686 | B2 | 4/2003 | Ollikainen et al. |
| 6,556,812 | B1 | 4/2003 | Pennanen et al. |
| 6,566,944 | B1 | 5/2003 | Pehlke |
| 6,580,396 | B2 | 6/2003 | Lin |
| 6,580,397 | B2 | 6/2003 | Lindell |
| 6,600,449 | B2 | 7/2003 | Onaka |
| 6,603,430 | B1 | 8/2003 | Hill et al. |
| 6,606,016 | B2 | 8/2003 | Takamine et al. |
| 6,611,235 | B2 | 8/2003 | Barna et al. |
| 6,614,400 | B2 | 9/2003 | Egorov |
| 6,614,401 | B2 | 9/2003 | Onaka et al. |
| 6,614,405 | B1 | 9/2003 | Mikkonen |
| 6,634,564 | B2 | 10/2003 | Kuramochi |
| 6,636,181 | B2 | 10/2003 | Asano |
| 6,639,564 | B2 | 10/2003 | Johnson |
| 6,646,606 | B2 | 11/2003 | Mikkola |
| 6,650,295 | B2 | 11/2003 | Ollikainen et al. |
| 6,657,593 | B2 | 12/2003 | Nagumo et al. |
| 6,657,595 | B1 | 12/2003 | Phillips et al. |
| 6,670,926 | B2 | 12/2003 | Miyasaka |
| 6,677,903 | B2 | 1/2004 | Wang |
| 6,680,705 | B2 | 1/2004 | Tan et al. |
| 6,683,573 | B2 | 1/2004 | Park |
| 6,693,594 | B2 | 2/2004 | Pankinaho et al. |
| 6,717,551 | B1 | 4/2004 | Desclos et al. |
| 6,727,857 | B2 | 4/2004 | Mikkola |
| 6,734,825 | B1 | 5/2004 | Guo et al. |
| 6,734,826 | B1 | 5/2004 | Dai et al. |
| 6,738,022 | B2 | 5/2004 | Klaavo et al. |
| 6,741,214 | B1 | 5/2004 | Kadambi et al. |
| 6,753,813 | B2 | 6/2004 | Kushihi |
| 6,759,989 | B2 | 7/2004 | Tarvas et al. |
| 6,765,536 | B2 | 7/2004 | Phillips et al. |
| 6,774,853 | B2 | 8/2004 | Wong et al. |
| 6,781,545 | B2 | 8/2004 | Sung |
| 6,801,166 | B2 | 10/2004 | Mikkola |
| 6,801,169 | B1 | 10/2004 | Chang et al. |
| 6,806,835 | B2 | 10/2004 | Iwai |
| 6,819,287 | B2 | 11/2004 | Sullivan et al. |
| 6,819,293 | B2 | 11/2004 | De Graauw |
| 6,825,818 | B2 | 11/2004 | Toncich |
| 6,836,249 | B2 | 12/2004 | Kenoun et al. |
| 6,847,329 | B2 | 1/2005 | Ikegaya et al. |
| 6,856,293 | B2 | 2/2005 | Bordi |
| 6,862,437 | B1 | 3/2005 | McNamara |
| 6,862,441 | B2 | 3/2005 | Ella |
| 6,873,291 | B2 | 3/2005 | Aoyama |
| 6,876,329 | B2 | 4/2005 | Milosavljevic |
| 6,882,317 | B2 | 4/2005 | Koskiniemi |
| 6,891,507 | B2 | 5/2005 | Kushihi et al. |
| 6,897,810 | B2 | 5/2005 | Dai et al. |
| 6,900,768 | B2 | 5/2005 | Iguchi et al. |
| 6,903,692 | B2 | 6/2005 | Kivekas |
| 6,911,945 | B2 | 6/2005 | Korva |
| 6,922,171 | B2 | 7/2005 | Annamaa |
| 6,925,689 | B2 | 8/2005 | Folkmar |
| 6,927,729 | B2 | 8/2005 | Legay |
| 6,937,196 | B2 | 8/2005 | Korva |
| 6,950,065 | B2 | 9/2005 | Ying et al. |
| 6,950,066 | B2 | 9/2005 | Hendler et al. |
| 6,950,068 | B2 | 9/2005 | Bordi |
| 6,950,072 | B2 | 9/2005 | Miyata et al. |
| 6,952,144 | B2 | 10/2005 | Javor |
| 6,952,187 | B2 | 10/2005 | Annamaa |
| 6,958,730 | B2 | 10/2005 | Nagumo et al. |
| 6,961,544 | B1 | 11/2005 | Hagstrom |
| 6,963,308 | B2 | 11/2005 | Korva |
| 6,963,310 | B2 | 11/2005 | Horita et al. |

(56) References Cited

U.S. PATENT DOCUMENTS

| | | | |
|---|---|---|---|
| 6,967,618 | B2 | 11/2005 | Ojantakanen |
| 6,975,278 | B2 | 12/2005 | Song et al. |
| 6,980,158 | B2 | 12/2005 | Iguchi et al. |
| 6,985,108 | B2 | 1/2006 | Mikkola |
| 6,992,543 | B2 | 1/2006 | Luetzelschwab et al. |
| 6,995,710 | B2 | 2/2006 | Sugimoto et al. |
| 7,023,341 | B2 | 4/2006 | Stilp |
| 7,031,744 | B2 | 4/2006 | Kuriyama et al. |
| 7,034,752 | B2 | 4/2006 | Sekiguchi et al. |
| 7,042,403 | B2 | 5/2006 | Colburn et al. |
| 7,053,841 | B2 | 5/2006 | Ponce De Leon et al. |
| 7,054,671 | B2 | 5/2006 | Kaiponen et al. |
| 7,057,560 | B2 | 6/2006 | Erkocevic |
| 7,061,430 | B2 | 6/2006 | Zheng et al. |
| 7,081,857 | B2 | 7/2006 | Kinnunen et al. |
| 7,084,831 | B2 | 8/2006 | Takagi et al. |
| 7,099,690 | B2 | 8/2006 | Milosavljevic |
| 7,113,133 | B2 | 9/2006 | Chen et al. |
| 7,119,749 | B2 | 10/2006 | Miyata et al. |
| 7,126,546 | B2 | 10/2006 | Annamaa |
| 7,129,893 | B2 | 10/2006 | Otaka et al. |
| 7,136,019 | B2 | 11/2006 | Mikkola |
| 7,136,020 | B2 | 11/2006 | Yamaki |
| 7,142,824 | B2 | 11/2006 | Kojima et al. |
| 7,148,847 | B2 | 12/2006 | Yuanzhu |
| 7,148,849 | B2 | 12/2006 | Lin |
| 7,148,851 | B2 | 12/2006 | Takaki et al. |
| 7,170,464 | B2 | 1/2007 | Tang et al. |
| 7,176,838 | B1 | 2/2007 | Kinezos |
| 7,180,455 | B2 | 2/2007 | Oh et al. |
| 7,193,574 | B2 | 3/2007 | Chiang et al. |
| 7,205,942 | B2 | 4/2007 | Wang et al. |
| 7,215,283 | B2 | 5/2007 | Boyle |
| 7,218,280 | B2 | 5/2007 | Annamaa |
| 7,218,282 | B2 | 5/2007 | Humpfer et al. |
| 7,224,313 | B2 | 5/2007 | McKinzie, III et al. |
| 7,230,574 | B2 | 6/2007 | Johnson |
| 7,233,775 | B2 | 6/2007 | De Graauw |
| 7,237,318 | B2 | 7/2007 | Annamaa |
| 7,256,743 | B2 | 8/2007 | Korva |
| 7,274,334 | B2 | 9/2007 | O'Riordan et al. |
| 7,283,097 | B2 | 10/2007 | Wen et al. |
| 7,289,064 | B2 | 10/2007 | Cheng |
| 7,292,200 | B2 | 11/2007 | Posluszny et al. |
| 7,319,432 | B2 | 1/2008 | Andersson |
| 7,330,153 | B2 | 2/2008 | Rentz |
| 7,333,067 | B2 | 2/2008 | Hung et al. |
| 7,339,528 | B2 | 3/2008 | Wang et al. |
| 7,340,286 | B2 | 3/2008 | Korva et al. |
| 7,345,634 | B2 | 3/2008 | Ozkar et al. |
| 7,352,326 | B2 | 4/2008 | Korva |
| 7,355,270 | B2 | 4/2008 | Hasebe et al. |
| 7,358,902 | B2 | 4/2008 | Erkocevic |
| 7,375,695 | B2 | 5/2008 | Ishizuka et al. |
| 7,381,774 | B2 | 6/2008 | Bish et al. |
| 7,382,319 | B2 | 6/2008 | Kawahata et al. |
| 7,385,556 | B2 | 6/2008 | Chung et al. |
| 7,388,543 | B2 | 6/2008 | Vance |
| 7,391,378 | B2 | 6/2008 | Mikkola |
| 7,405,702 | B2 | 7/2008 | Annamaa et al. |
| 7,417,588 | B2 | 8/2008 | Castany et al. |
| 7,423,592 | B2 | 9/2008 | Pros et al. |
| 7,432,860 | B2 | 10/2008 | Huynh |
| 7,439,929 | B2 | 10/2008 | Ozkar |
| 7,443,344 | B2 | 10/2008 | Boyle |
| 7,468,700 | B2 | 12/2008 | Milosavlejevic |
| 7,468,709 | B2 | 12/2008 | Niemi |
| 7,498,990 | B2 | 3/2009 | Park et al. |
| 7,501,983 | B2 | 3/2009 | Mikkola |
| 7,502,598 | B2 | 3/2009 | Kronberger |
| 7,564,413 | B2 | 7/2009 | Kim et al. |
| 7,589,678 | B2 | 9/2009 | Perunka et al. |
| 7,616,158 | B2 | 11/2009 | Mark et al. |
| 7,633,449 | B2 | 12/2009 | Oh |
| 7,663,551 | B2 | 2/2010 | Nissinen |
| 7,679,565 | B2 | 3/2010 | Sorvala |
| 7,692,543 | B2 | 4/2010 | Copeland |
| 7,710,325 | B2 | 5/2010 | Cheng |
| 7,724,204 | B2 | 5/2010 | Annamaa |
| 7,760,146 | B2 | 7/2010 | Ollikainen |
| 7,764,245 | B2 | 7/2010 | Loyet |
| 7,786,938 | B2 | 8/2010 | Sorvala |
| 7,800,544 | B2 | 9/2010 | Thornell-Pers |
| 7,830,327 | B2 | 11/2010 | He |
| 7,843,397 | B2 | 11/2010 | Boyle |
| 7,889,139 | B2 | 2/2011 | Hobson et al. |
| 7,889,143 | B2 | 2/2011 | Milosavljevic |
| 7,901,617 | B2 | 3/2011 | Taylor |
| 7,903,035 | B2 | 3/2011 | Mikkola et al. |
| 7,916,086 | B2 | 3/2011 | Koskiniemi et al. |
| 7,963,347 | B2 | 6/2011 | Pabon |
| 7,973,720 | B2 | 7/2011 | Sorvala |
| 8,049,670 | B2 | 11/2011 | Jung et al. |
| 8,054,232 | B2 | 11/2011 | Chiang et al. |
| 8,098,202 | B2 | 1/2012 | Annamaa et al. |
| 8,179,322 | B2 | 5/2012 | Nissinen |
| 8,193,998 | B2 | 6/2012 | Puente et al. |
| 8,378,892 | B2 | 2/2013 | Sorvala |
| 8,466,756 | B2 | 6/2013 | Milosavljevic et al. |
| 8,473,017 | B2 | 6/2013 | Milosavljevic et al. |
| 8,564,485 | B2 | 10/2013 | Milosavljevic et al. |
| 8,629,813 | B2 | 1/2014 | Milosavljevic |
| 2001/0050636 | A1 | 12/2001 | Weinberger |
| 2002/0183013 | A1 | 12/2002 | Auckland et al. |
| 2002/0196192 | A1 | 12/2002 | Nagumo et al. |
| 2003/0146873 | A1 | 8/2003 | Blancho |
| 2004/0090378 | A1 | 5/2004 | Dai et al. |
| 2004/0137950 | A1 | 7/2004 | Bolin et al. |
| 2004/0145525 | A1 | 7/2004 | Annabi et al. |
| 2004/0171403 | A1 | 9/2004 | Mikkola |
| 2005/0057401 | A1 | 3/2005 | Yuanzhu |
| 2005/0159131 | A1 | 7/2005 | Shibagaki et al. |
| 2005/0176481 | A1 | 8/2005 | Jeong |
| 2006/0071857 | A1 | 4/2006 | Pelzer |
| 2006/0192723 | A1 | 8/2006 | Harada |
| 2007/0042615 | A1 | 2/2007 | Liao |
| 2007/0082789 | A1 | 4/2007 | Nissila |
| 2007/0152881 | A1 | 7/2007 | Chan |
| 2007/0188388 | A1 | 8/2007 | Feng |
| 2008/0055164 | A1 | 3/2008 | Zhang et al. |
| 2008/0059106 | A1 | 3/2008 | Wight |
| 2008/0088511 | A1 | 4/2008 | Sorvala |
| 2008/0266199 | A1 | 10/2008 | Milosavljevic |
| 2009/0009415 | A1 | 1/2009 | Tanska |
| 2009/0135066 | A1 | 5/2009 | Raappana et al. |
| 2009/0153412 | A1 | 6/2009 | Chiang et al. |
| 2009/0174604 | A1 | 7/2009 | Keskitalo |
| 2009/0196160 | A1 | 8/2009 | Crombach |
| 2009/0197654 | A1 | 8/2009 | Teshima |
| 2009/0231213 | A1 | 9/2009 | Ishimiya |
| 2010/0103070 | A1 | 4/2010 | Coupez |
| 2010/0220016 | A1 | 9/2010 | Nissinen |
| 2010/0244978 | A1 | 9/2010 | Milosavljevic |
| 2010/0309092 | A1 | 12/2010 | Lambacka |
| 2011/0133994 | A1 | 6/2011 | Korva |
| 2012/0119955 | A1 | 5/2012 | Milosavljevic et al. |

FOREIGN PATENT DOCUMENTS

| | | |
|---|---|---|
| DE | 10150149 | 4/2003 |
| EP | 0 208 424 | 1/1987 |
| EP | 0 376 643 | 4/1990 |
| EP | 0 751 043 | 4/1997 |
| EP | 0 807 988 | 11/1997 |
| EP | 0 831 547 | 3/1998 |
| EP | 0 851 530 | 7/1998 |
| EP | 1 294 048 | 1/1999 |
| EP | 1 014 487 | 6/2000 |
| EP | 1 024 553 | 8/2000 |
| EP | 1 067 627 | 1/2001 |
| EP | 0 923 158 | 9/2002 |
| EP | 1 329 980 | 7/2003 |
| EP | 1 361 623 | 11/2003 |
| EP | 1 406 345 | 4/2004 |

(56) References Cited

FOREIGN PATENT DOCUMENTS

| | | |
|---|---|---|
| EP | 1 453 137 | 9/2004 |
| EP | 1 220 456 | 10/2004 |
| EP | 1 467 456 | 10/2004 |
| EP | 1 753 079 | 2/2007 |
| FI | 20020829 | 11/2003 |
| FI | 118782 | 3/2008 |
| FR | 2553584 | 10/1983 |
| FR | 2724274 | 3/1996 |
| FR | 2873247 | 1/2006 |
| GB | 2266997 | 11/1993 |
| GB | 2360422 | 9/2001 |
| GB | 2389246 | 12/2003 |
| JP | 59-202831 | 11/1984 |
| JP | 60-206304 | 10/1985 |
| JP | 61-245704 | 11/1986 |
| JP | 06-152463 | 5/1994 |
| JP | 07-131234 | 5/1995 |
| JP | 07-221536 | 8/1995 |
| JP | 07-249923 | 9/1995 |
| JP | 07-307612 | 11/1995 |
| JP | 08-216571 | 8/1996 |
| JP | 09-083242 | 3/1997 |
| JP | 09-260934 | 10/1997 |
| JP | 09-307344 | 11/1997 |
| JP | 10-028013 | 1/1998 |
| JP | 10-107671 | 4/1998 |
| JP | 10-173423 | 6/1998 |
| JP | 10-209733 | 8/1998 |
| JP | 10-224142 | 8/1998 |
| JP | 10-322124 | 12/1998 |
| JP | 10-327011 | 12/1998 |
| JP | 11-004113 | 1/1999 |
| JP | 11-004117 | 1/1999 |
| JP | 11-068456 | 3/1999 |
| JP | 11-127010 | 5/1999 |
| JP | 11-127014 | 5/1999 |
| JP | 11-136025 | 5/1999 |
| JP | 11-355033 | 12/1999 |
| JP | 2000-278028 | 10/2000 |
| JP | 2001-053543 | 2/2001 |
| JP | 2001-267833 | 9/2001 |
| JP | 2001-217631 | 10/2001 |
| JP | 2001-326513 | 11/2001 |
| JP | 2002-319811 | 10/2002 |
| JP | 2002-329541 | 11/2002 |
| JP | 2002-335117 | 11/2002 |
| JP | 2003-060417 | 2/2003 |
| JP | 2003-124730 | 4/2003 |
| JP | 2003-179426 | 6/2003 |
| JP | 2004-112028 | 4/2004 |
| JP | 2004-363859 | 12/2004 |
| JP | 2005-005985 | 1/2005 |
| JP | 2005-252661 | 9/2005 |
| KR | 20010080521 | 10/2001 |
| KR | 20020096016 | 12/2002 |
| SE | 511900 | 12/1999 |
| WO | WO 92/00635 | 1/1992 |
| WO | WO 96/27219 | 9/1996 |
| WO | WO 98/01919 | 1/1998 |
| WO | WO 99/30479 | 6/1999 |
| WO | WO 01/20718 | 3/2001 |
| WO | WO 01/29927 | 4/2001 |
| WO | WO 01/33665 | 5/2001 |
| WO | WO 01/61781 | 8/2001 |
| WO | WO 2004/017462 | 2/2004 |
| WO | WO 2004/057697 | 7/2004 |
| WO | WO 2004/100313 | 11/2004 |
| WO | WO 2004/112189 | 12/2004 |
| WO | WO 2005/062416 | 7/2005 |
| WO | WO 2007/012697 | 2/2007 |
| WO | WO 2010/122220 | 10/2010 |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. and M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.

Cheng-Nan Hu, Willey Chen, and Book Tai, "A Compact Multi-Band Antenna Design for Mobile Handsets", *APMC 2005 Proceedings*.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

European Office Action, May 30, 2005 issued during prosecution of EP 04 396 001.2-1248.

Examination Report dated May 3, 2006 issued by the EPO for European Patent Application No. 04 396 079.8.

F.R. Hsiao, et al. "A dual-band planar inverted-F patch antenna with a branch-line slit," *Microwave Opt. Technol. Lett.*, vol. 32, Feb. 20, 2002.

Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.

Guo, Y. X. and H. S. Tan, "New compact six-band internal antenna," *IEEE Antennas and Wireless Propagation Letters*, vol. 3, 295-297, 2004.

Guo, Y. X. and Y.W. Chia and Z. N. Chen, "Miniature built-in quadband antennas for mobile handsets", *IEEE Antennas Wireless Propag. Lett.*, vol. 2, pp. 30-32, 2004.

Hoon Park, et al. "Design of an Internal antenna with wide and multiband characteristics for a mobile handset", *IEEE Microw. & Opt. Tech. Lett.* vol. 48, No. 5, May 2006.

Hoon Park, et al. "Design of Planar Inverted-F Antenna With Very Wide Impedance Bandwidth", *IEEE Microw. & Wireless Comp., Lett.*, vol. 16, No. 3, pp. 113-115-, Mar. 2006.

Hossa, R., A. Byndas, and M. E. Bialkowski, "Improvement of compact terminal antenna performance by incorporating open-end slots in ground plane," *IEEE Microwave and Wireless Components Letters*, vol. 14, 283-285, 2004.

I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.

International Preliminary Report on Patentability for International Application No. PCT/FI2004/000554, date of issuance of report May 1, 2006.

Jing, X., et al.; "Compact Planar Monopole Antenna for Multi-Band Mobile Phones"; Microwave Conference Proceedings, 4.-7.12. 2005.APMC 2005, Asia-Pacific Conference Proceedings, vol. 4.

Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.

Kim, Kihong et al., "Integrated Dipole Antennas on Silicon Substrates for Intra-Chip Communication", IEEE, pp. 1582-1585, 1999.

Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71{86, 2004.

K-L Wong, *Planar Antennas for Wireless Communications*, Hoboken, NJ: Willey, 2003, ch. 2.

(56) References Cited

OTHER PUBLICATIONS

Lindberg., P. and E. Ojefors, "A bandwidth enhancement technique for mobile handset antennas using wavetraps," *IEEE Transactions on Antennas and Propagation*, vol. 54, 2226{2232, 2006.
Marta Martinez-Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", *Electronic Letters*, vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.*, vol. 14, No. 4, pp. 148-150, Apr. 2004.
P. Salonen, et al. "New slot configurations for dual-band planar inverted-F antenna," *Microwave Opt. Technol.*, vol. 28, pp. 293-298, 2001.
Papapolymerou, Ioannis et al., "Micromachined Patch Antennas", IEEE Transactions on Antennas and Propagation, vol. 46, No. 2, pp. 275-283, Feb. 1998.
Product of the Month, RFDesign, "GSM/GPRS Quad Band Power Amp Includes Antenna Switch," 1 page, reprinted Nov. 2004 issue of RF Design (www.rfdesign.com), Copyright 2004, Freescale Semiconductor, RFD-24-EK.
S. Tarvas, et al. "An internal dual-band mobile phone antenna," in *2000 IEEE Antennas Propagat. Soc. Int. Symp. . . . Dig.*, pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs": IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. 2003, vol. 51, No. 1.
X.-D. Cai and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Joshi, Ravi K., et al., "Broadband Concentric Rings Fractal Slot Antenna", XXVIIIth General Assembly of International Union of Radio Science (URSI). (Oct. 23-29, 2005), 4 Pgs.
Singh, Rajender, "Broadband Planar Monopole Antennas," M.Tech credit seminar report, Electronic Systems group, EE Dept, IIT Bombay, Nov. 2003, pp. 1-24.
Gobien, Andrew, T. "Investigation of Low Profile Antenna Designs for Use in Hand-Held Radios," Ch.3, *The Inverted-L Antenna and Variations*; Aug. 1997, pp. 42-76.
See, C.H., et al., "Design of Planar Metal-Plate Monopole Antenna for Third Generation Mobile Handsets," Telecommunications Research Centre, Bradford University, 2005, pp. 27-30.
Chen, Jin-Sen, et al., "CPW-fed Ring Slot Antenna with Small Ground Plane," Department of Electronic Engineering, Cheng Shiu University.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun Yat-Sen University, Sep. 2002 Ansoft Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.
Extended European Search Report dated Jan. 30, 2013, issued by the EPO for EP Patent Application No. 12177740.3.

LOW PASSIVE INTERMODULATION DISTRIBUTED ANTENNA SYSTEM FOR MULTIPLE-INPUT MULTIPLE-OUTPUT SYSTEMS AND METHODS OF USE

RELATED APPLICATIONS

This application is related to U.S. Provisional Patent Application Ser. No. 61/864,432 entitled "LOW PASSIVE INTERMODULATION ANTENNA APPARATUS AND METHODS OF USE" filed Aug. 9, 2013, the contents of which are incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

1. Technological Field

The present disclosure relates generally to antenna solutions and more particularly in one exemplary aspect to antenna solutions that have a desired peak passive intermodulation ("PIM") performance; e.g., in one embodiment lower than −155 dBc.

2. Description of Related Technology

Antennas in wireless communication networks are critical devices for both transmitting and receiving signals with and without amplification. With the evolution of network communication technology migrating from less to more capable technology; e.g., third generation systems ("3G") to fourth generation systems ("4G") with higher power, the need for antennas which can clearly receive fundamental frequencies or signals with minimal distortion are becoming more critical. The distortion experienced during signal reception is due in large part to the by-products of the mixture of these fundamental signals. Passive intermodulation, or PIM, is the undesired by-products of these mixed signals, which can severely interfere and inhibit the efficiency of a network system's capability in receiving the desired signals. With higher carrier power levels experienced in today's modern wireless communication networks, low PIM antennas with a peak PIM performance (for instance, lower than about −155 decibels relative to the carrier ("dBc") for cellular network applications are desired (such as 3G (e.g., 3GPP, 3GPP2, and UMTS), HSDPA/HSUPA, TDMA, CDMA (e.g., IS-95A, WCDMA, etc.), GSM, WiMAX (802.16), Long Term Evolution ("LTE") and LIE-Advanced ("LTE-A"), etc.). In addition, over time, the PIM value may drop due to nonlinearity, dissimilar materials, thermal expansion and/or contraction, and galvanic corrosion.

The radiating elements as well as other mechanical parts for prior art lower PIM antennas are often customized for each specific application and configuration. These antenna sizes can vary widely and most implementations can reach a peak PIM performance as low as −150 dBc. Furthermore, in certain prior art implementations, the current level of isolation at the lower frequency hand (e.g., 698-960 MHz) as well as the upper frequency band (e.g., 1710-2700/4900-5900 MHz) is typically on the order of approximately −25 dB. The isolation level at the 700 MHz LTE band is more challenging within a limited space due in part to its electrical wavelength. For example, most current distributed antenna system ("DAS") antenna solutions cannot offer a peak PIM performance lower than −155 dBc (as is often desired by the latest network communication systems) as well as the lower level of isolation between closely located antennas desired (such as multiple-in multiple-out ("MIMO") antennas) in order to reduce, inter alia, the bit error rate ("BER").

Accordingly, there is a need for apparatus, systems and methods that provides a smaller size DAS antenna solution that is aesthetically pleasing with a reduced number of physical and functional parts while offering a PIM performance lower than −155 dBc. Additionally, while current techniques for improving isolation by extending the ground plane between adjacently disposed MIMO antennas does improve the isolation between the two operating bands, such an approach often distorts the radiation antenna pattern for the DAS antenna. Accordingly, a solution that improves upon antenna isolation between operating bands while providing a minimal level of distortion to the radiation pattern (i.e., making the antenna operate in a more omni-directional manner) is desirable as well.

SUMMARY

The aforementioned needs are satisfied herein by providing improved antenna apparatus, and methods for manufacturing and using the same.

In a first aspect, a low passive intermodulation (PIM) antenna apparatus is disclosed. In one embodiment, the low PIM antenna apparatus includes a pair of radiating elements; a ground plane upon which the pair of radiating elements are disposed; and one or more isolation rings disposed between the pair of radiating elements, the one or more isolation rings being electrically coupled to the ground plane.

In a second aspect, a ground plane apparatus for use with an antenna apparatus such as, for example, a low PIM antenna apparatus is disclosed.

In a third aspect, a radiating element for use with an antenna apparatus such as, for example, a low PIM antenna apparatus is disclosed.

In a fourth aspect, an isolation ring for use with the aforementioned low PIM antenna apparatus is disclosed.

In a fifth aspect, a radome for use with the aforementioned low PIM antenna apparatus is disclosed.

In a sixth aspect, methods of manufacturing the aforementioned low PIM antenna apparatus are disclosed.

In a seventh aspect, methods of manufacturing the aforementioned ground plane apparatus are disclosed.

In an eighth aspect, methods of manufacturing the aforementioned radiating element are disclosed.

In a ninth aspect, methods of manufacturing the aforementioned isolation ring are disclosed.

In a tenth aspect, methods of manufacturing the aforementioned radome are disclosed.

In an eleventh aspect, methods of using the aforementioned antenna apparatus are disclosed.

Various objects, features, aspects and advantages of the inventive subject matter will become more apparent from the following detailed description of preferred embodiments, along with the accompanying drawings.

BRIEF DESCRIPTION OF THE DRAWINGS

The features, objectives, and advantages of the disclosure will become more apparent from the detailed description set forth below when taken in conjunction with the drawings, wherein.

DETAILED DESCRIPTION

Figure 1:
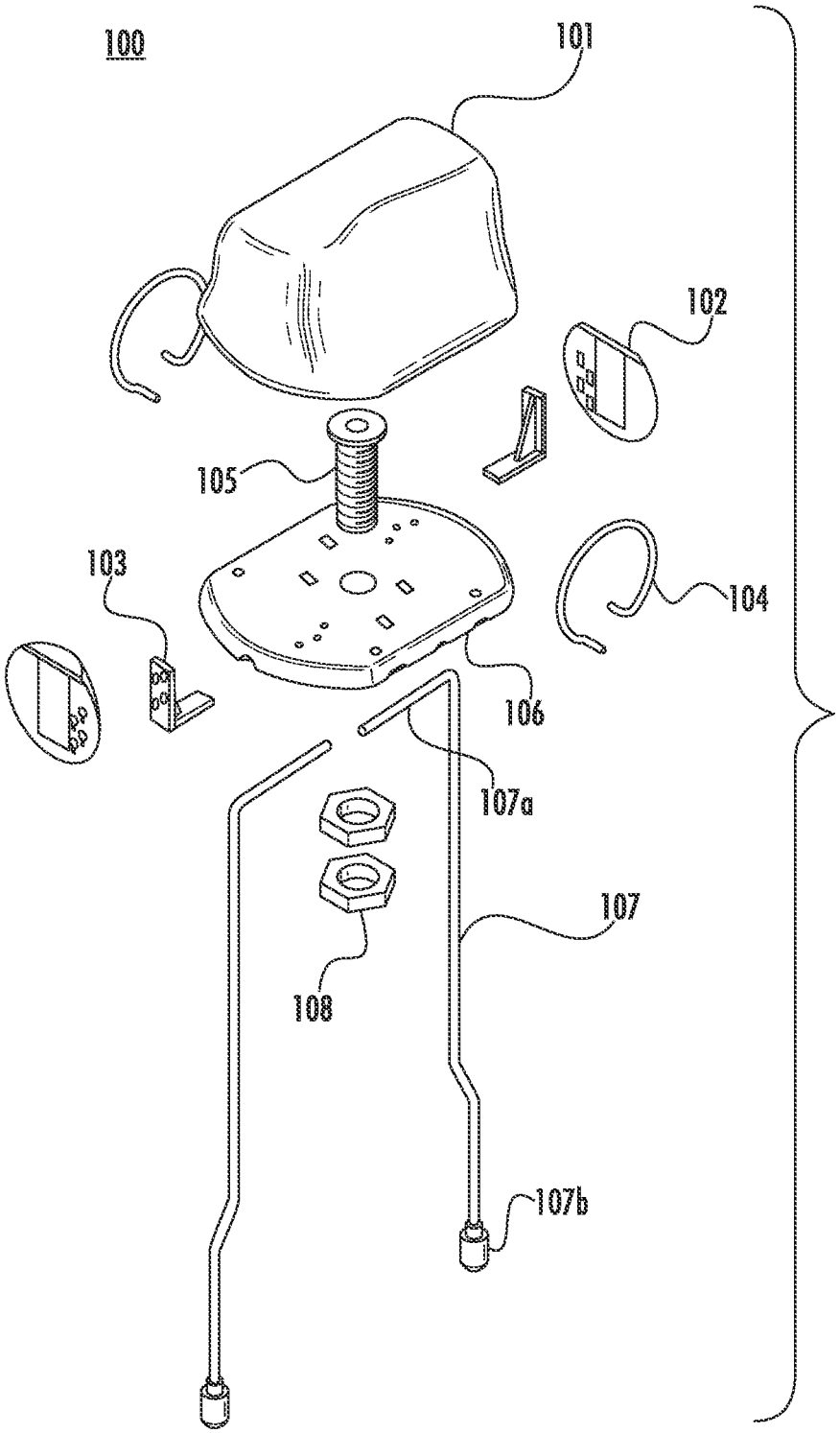
FIG. 1 is an exploded perspective view of various components of one embodiment of the low PIM antenna apparatus in accordance with the principles of the present disclosure.

Reference is now made to the drawings wherein like numerals refer to like parts throughout.

As used herein, the terms "antenna", and "antenna assembly" refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, or more repeater links, and one or more locations may be mobile, stationary, or fixed to a location on earth such as a base station.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

Furthermore, as used herein, the terms "radiator," "radiating plane," and "radiating element" refer without limitation to an element that can function as part of a system that receives and/or transmits radio-frequency electromagnetic radiation; e.g., an antenna. Hence, an exemplary radiator may receive electromagnetic radiation, transmit electromagnetic radiation, or both.

The terms "feed", and "RE feed" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the tem "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LIE-Advanced (LIE-A), analog cellular, Zigbee, Near field communication (NFC)/RFID, CDPD, satellite systems such as GPS and GLONASS, and millimeter wave or microwave systems.

Overview

The present disclosure provides, inter alia, improved low PIM antenna components, assemblies, and methods for manufacturing and utilizing the same.

More specifically, embodiments of the low PIM antenna assemblies described herein offer: (1) the lowest PIM level for a DAS antenna as compared with current PIM solutions currently available in the market place as well as; (2) improvement of isolation (e.g., better than −25 dB over each of the operational frequency bands) using inserted isolation rings as well as; (3) a more omni-directional radiation pattern using slots (e.g., rectangular slots) on the radiating elements themselves. For example, embodiments of the present disclosure provide for a 25% improvement of isolation between the two radiating elements of the low PIM antenna assembly in the 700 MHz band as compared with solutions currently available on the market. Moreover, embodiments of the present disclosure provide for a reduced number of physical/functional parts for the low PIM antenna assembly which is not only aesthetically pleasing but offers a long term low peak PIM performance of better than −155 dBc with a relatively small product size.

Methods of manufacturing and using the aforementioned low PIM antenna assemblies are also disclosed.

Exemplary Embodiments

Detailed descriptions of the various embodiments and variants of the apparatus and methods of the present disclosure are now provided. While primarily discussed in the context of low passive intermodulation ("PIM") antennas for distributed antenna systems ("DAS"), the various apparatus and methodologies discussed herein are not so limited. In fact, many of the apparatus and methodologies described herein are useful in the manufacture of any number of antenna apparatus that can benefit from the radiating element, isolation ring and ground plane geometries and methods described herein, which may also be useful in different applications, and/or provide different signal conditioning functions.

Moreover, some exemplary embodiments of the present disclosure relate to low cost, low PIM antennas for DAS/MIMO with broadband frequencies in the range of, for example, 698-5900 MHz. While primarily discussed in the exemplary operating range of 698-5900 MHz, it is appreciated that the low PIM antenna embodiments described herein may be readily adapted to operate in other frequency ranges with proper adaptation as would be understood by one of ordinary skill given the present disclosure. Antenna embodiments of the present disclosure also include a plastic radome, a conductive (e.g. metal) radiating element, a conductive (e.g. metal) ground plane, and a feeding network, the latter which may comprise, for example, a dual custom cable pigtail with custom connectors and adapters. The radiating element and the ground plane are, in one implementation, specifically made to meet desired voltage standing wave ratios ("VWSR") with form factors and assembly techniques which help to achieve the desired PIM level for use in e.g., modern wireless communication networks.

Low Passive intermodulation (PIM) Antenna Apparatus—

Referring now to FIG. 1, a first embodiment of a low PIM antenna apparatus 100 for use in a DAS is shown and described in detail. The antenna apparatus includes a radome 101 made from a non-conductive polymer (e.g., plastic). The antenna apparatus also includes two conductive radiating elements 102 as well as two non-conductive radiator holders 103 that are configured to support the radiating elements. In one exemplary configuration, the radiator holders are manufactured from an injection molded polymer and include features (e.g., snaps, polymer screws, heat-staking studs, etc.) that are configured to interface with respective features located on the radiating elements themselves. The antenna apparatus further includes a conductive (e.g., metal) ground plane 106 as well as two custom cable pigtails with custom low PIM connectors 107. Also included are a threaded stem 105 that are, in an exemplary embodiment, made from a polymer material as well as two custom polymer nuts 108. While a specific configuration for the threaded stem and polymer nuts is illustrated, it is appreciated that varying geometries may be utilized in place of the specific embodiments illustrated. For example, the polymer nuts could be made of a larger size with a molded flange (not shown) incorporated therein. The molded flange would then function as a washer which is useful in, for example, cost reduction by enabling the reduction of component count for the antenna apparatus (i.e., as opposed to the use of a smaller polymer nut and a separate washer). The antenna apparatus further includes a pair of isolation rings 104 that are discussed in subsequent detail herein. In an exemplary embodiment, each of the electrical components of the antenna apparatus (i.e., the radiating elements 102, ground plane 106 and low PIM connectors 107) are each made from a common nonferrous material such as brass or copper.

In one exemplary embodiment, the conductive ground plane 106 is made from a non-ferromagnetic metal. Alternatively, the conductive ground plane 106 may only consist of non-ferromagnetic plating, either wholly plated (i.e. over entire surface of the ground plane) or locally plated for soldering of the isolation rings 104 to the ground plane. In embodiments in which the conductive ground plane is locally plated, the ground plane will preferably be protected elsewhere from corrosion by, for example, surface treatment such as via chemical conversion, plating, etc. so long as these treatments do not contain any ferromagnetic metal material. The embodiment illustrated in FIG. 1 also addresses prior art issues associated with DAS implementation, whereby the PIM value drops over time due to nonlinearity, dissimilar materials, thermal expansion and contraction as well as galvanic corrosion. Specifically, the embodiment of FIG. 1 eliminates nonlinearity by avoiding the use of dissimilar materials (e.g., screws, rivets and gaps from around the connector flange). In order to reduce the diameter of the ground plane 106 and increase the electrical length, forming the ground plane is required. Forming the ground plane adds approximately 15 mm electrical length. The front to back ratios is improved, PIM level is improved by approximately −5 dBc.

Figure 1A:
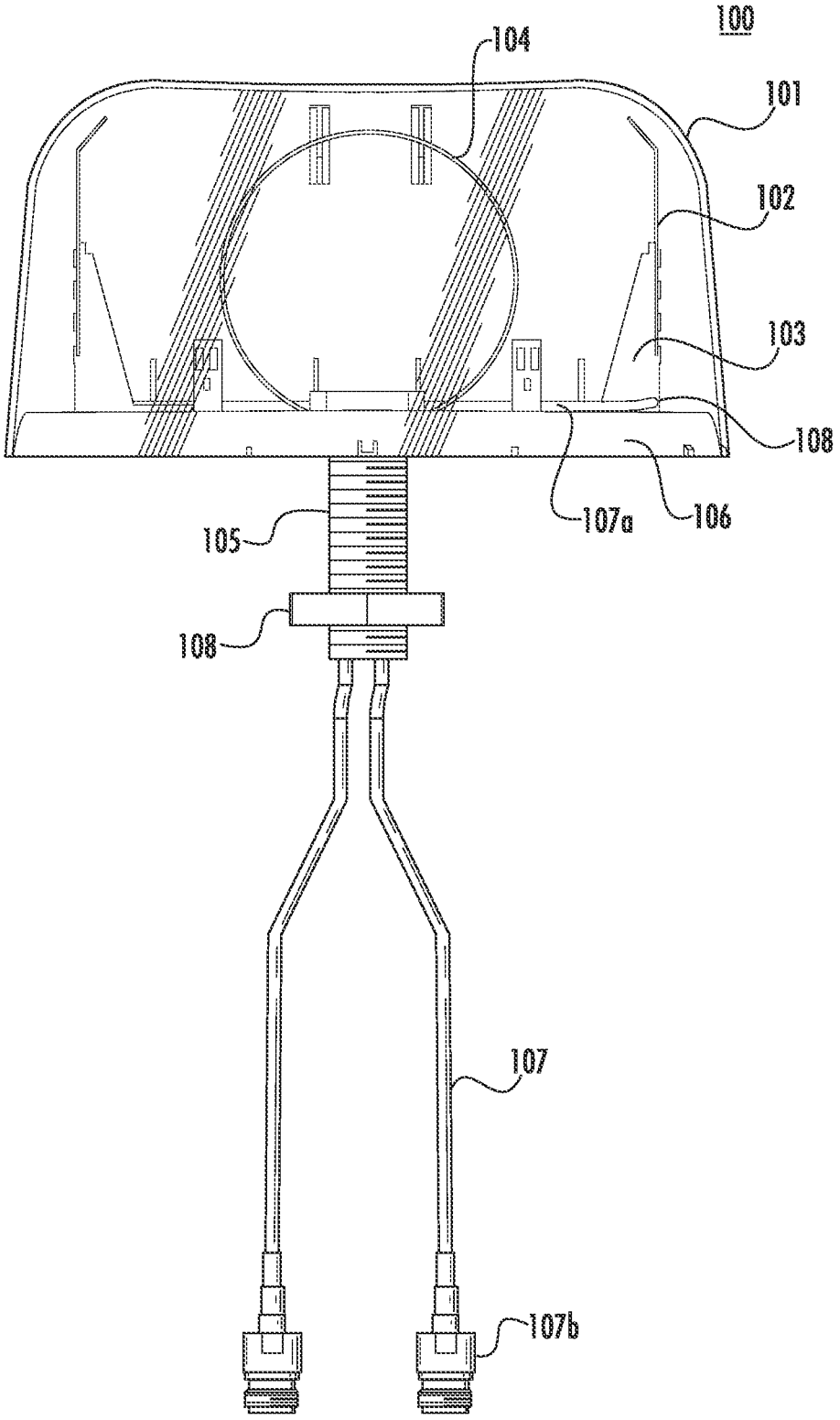
FIG. 1A is a plan view of the low PIM antenna apparatus of FIG. 1, manufactured in accordance with the principles of the present disclosure.

Referring now to FIG. 1A, a front view of the low PIM antenna apparatus 100 is illustrated in its assembled form with the radome cover shown in a transparent manner so that the internal components of the low PIM antenna apparatus are readily visible. Specifically, the connection of the low PIM connectors 107 is shown coupled to the radiating elements 102. As illustrated in FIG. 1A, the feed ends 107*a* of the low PIM connector cable assembly 107 is shown coupled to the radiating elements at location 108. Furthermore, the threaded stem 105 is configured such that the low PIM antenna apparatus 100 may be mounted directly to, for example, an office ceiling tile (not shown) via a through hole sized to accommodate the threaded stem and the polymer nut 108. The opposing end 107*b* of the low PIM connectors consists of a standard connector of an N or 7-16DIN type soldered to the semi flexible cable 107. Although an N or 7-16DIN type connector is shown, other suitable connector types may be substituted in lieu of the specific connector ends 107*b* shown. The semi flexible cable preferably has sufficient flexibility so as to enable ease of assembly and can be of any desired length as long as the gain loss of the low PIM connectors 107 is of an acceptable nature. While the use of a semi-flexible cable is exemplary, it is appreciated that the low PIM connectors 107 may be instead made from a semi-rigid cable of a similar size even through the resulting connector will have less flexibility.

Figure 1B:
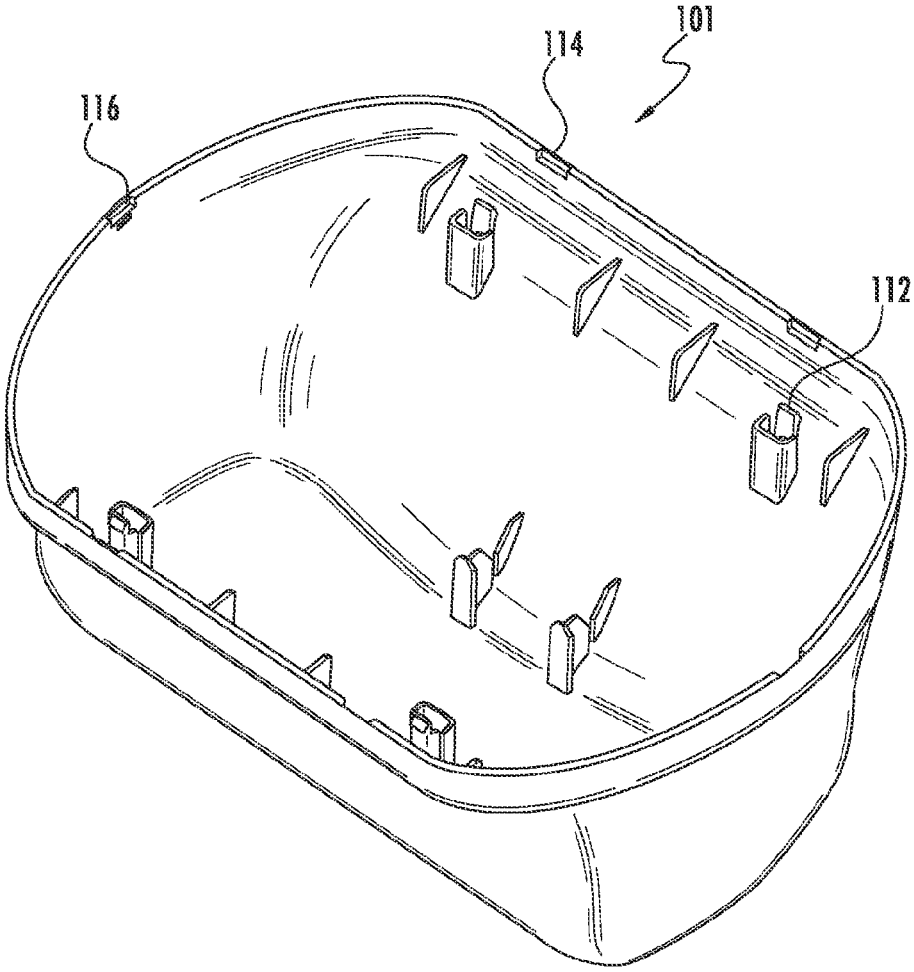
FIG. 1B is a perspective view of the underside of the radome cover utilized in conjunction with the exemplary low PIM antenna apparatus of FIG. 1.

Referring now to FIG. 1B, a perspective view of the inside portion of the radome 101 is illustrated. Specifically, the means for attaching and securing the radome to the ground plane (106, FIG. 1) is shown. As can be seen, the radome includes a number of cantilever snaps 112 (four (4) cantilever snaps are shown) that secure the radome via respective features located on the ground plane. In addition, various positioning features 114, 116 are also illustrated that help align the radome once positioned onto the ground plane. While the positioning of the various cantilever snaps 112 and positioning features 114, 116 are illustrated in an exemplary configuration, it is appreciated that the various positions shown can be varied along with the shapes of the cantilever snaps and positioning features themselves without departing from the principles of the present disclosure. Moreover, while the use of cantilever snaps is exemplary, it is appreciated that the ground plane 106 may be secured to the radome with polymer-based (e.g., plastic screws) or even stainless steel screws via the inclusion of molded bosses (not shown) within the radome without adversely affecting PIM performance. In yet another alternative embodiment, the low PIM antenna apparatus can be manufactured so as to address the ingress of foreign materials within the radome. For example, in one exemplary embodiment, the low PIM antenna apparatus is manufactured so as to be compliant with an IP67 rating. In other words, the low PIM antenna apparatus will be fully protected against dust while also being protected against the effect of ambient water moisture. Such a configuration will include an O-ring gasket (not shown) disposed between the radome 101 and the ground plane 106. Furthermore, such a configuration may use, for example, screws that are used to affix the ground plane to the radome in combination with an optional epoxy back bill used in the ground plane cut outs as well as around the threaded stem.

Figure 1C:
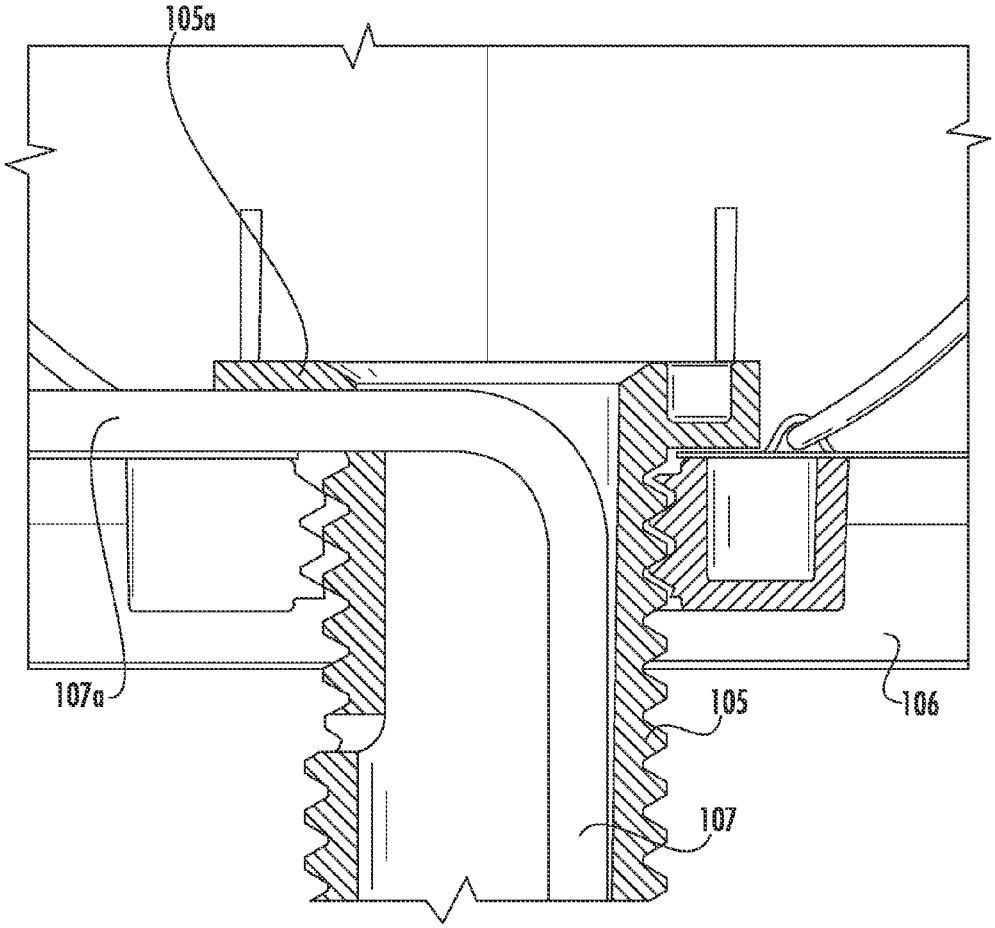
FIG. 1C is a detailed view illustrating the multifunctional nature of the exemplary low PIM antenna apparatus of FIG. 1.

Referring now to FIG. 1C, a detailed sectional view illustrating the multifunctional design of the threaded stem 105, ground plane 106 and polymer nut (108, FIG. 1) is shown and described in detail. Specifically, the combinations of the threaded stem, ground plane and polymer nut, when assembled, provides for strain relief for the low PIM connector cable assembly 107. Specifically, the head portion 105*a* of the threaded stem 105, when the polymer nut is secured thereto, applies pressure to the feed end 107*a* of the low PIM connector cable assembly 107. Such a configuration is useful in that any additional strain relief apparatus has now been obviated in view of these components. By minimizing the amount of components, prior art issues associated with DAS implementations whereby the PIM value drops over time due to, for example, dissimilar materials and thermal expansion/contraction of the assembly are in turn minimized.

Low Passive Intermodulation (PIM) Antenna Performance—

Figure 2A:
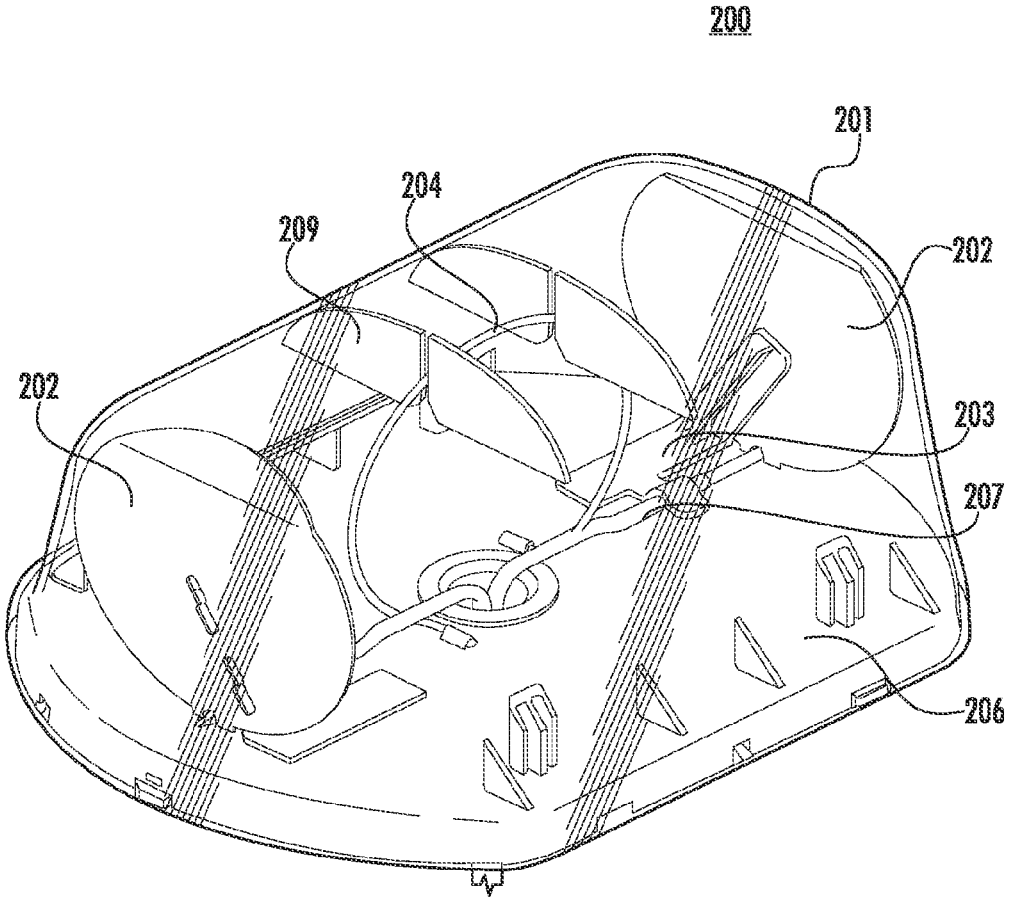
FIG. 2A is a perspective view of a second exemplary low PIM antenna apparatus, in accordance with the principles of the present disclosure.

Referring now to FIG. 2A, an alternative low PIM antenna apparatus 200 is shown and described in detail. Similar to the antenna apparatus illustrated in FIG. 1, the antenna apparatus of FIG. 2A includes a radome 201 made from a non-conductive polymer (e.g., plastic). The antenna apparatus also includes two conductive radiating elements 202 (e.g., MIMO antenna radiating elements) as well as two non-conductive radiator holders 203. The antenna apparatus further includes a conductive (e.g., metal) ground plane 206 as well as two custom cable pigtails with custom low PIM connectors 207. However, unlike the embodiment discussed with respect to FIG. 1, the antenna apparatus only includes a single isolation ring 204. The radome 201 also includes a pair of isolation ring retention features 209 that are configured to maintain the isolation ring 204 in a desired orientation (e.g., in an orthogonal orientation with respect to the radiating elements 202).

The insertion of a ground plane between the two radiating elements is a known method for improving isolation. However, the insertion of a ground plane between the two radiating elements results in radiation pattern distortion for the antenna apparatus. Accordingly, to improve the isolation of the low PIM antenna apparatus 200, it was found that the insertion of a relatively thin wire ring (such as isolation ring 204) between the two radiating elements 202 not only: (1) improves the isolation between the radiating elements; but also (2) provides for a more desirable radiation pattern for the low PIM antenna apparatus. In other words, the isolation rings are virtually invisible to the antenna radiating patterns; however, they may still disrupt the coupling between the two radiating elements thereby increasing the isolation to greater than or equal to −25 dB.

Figure 2B:
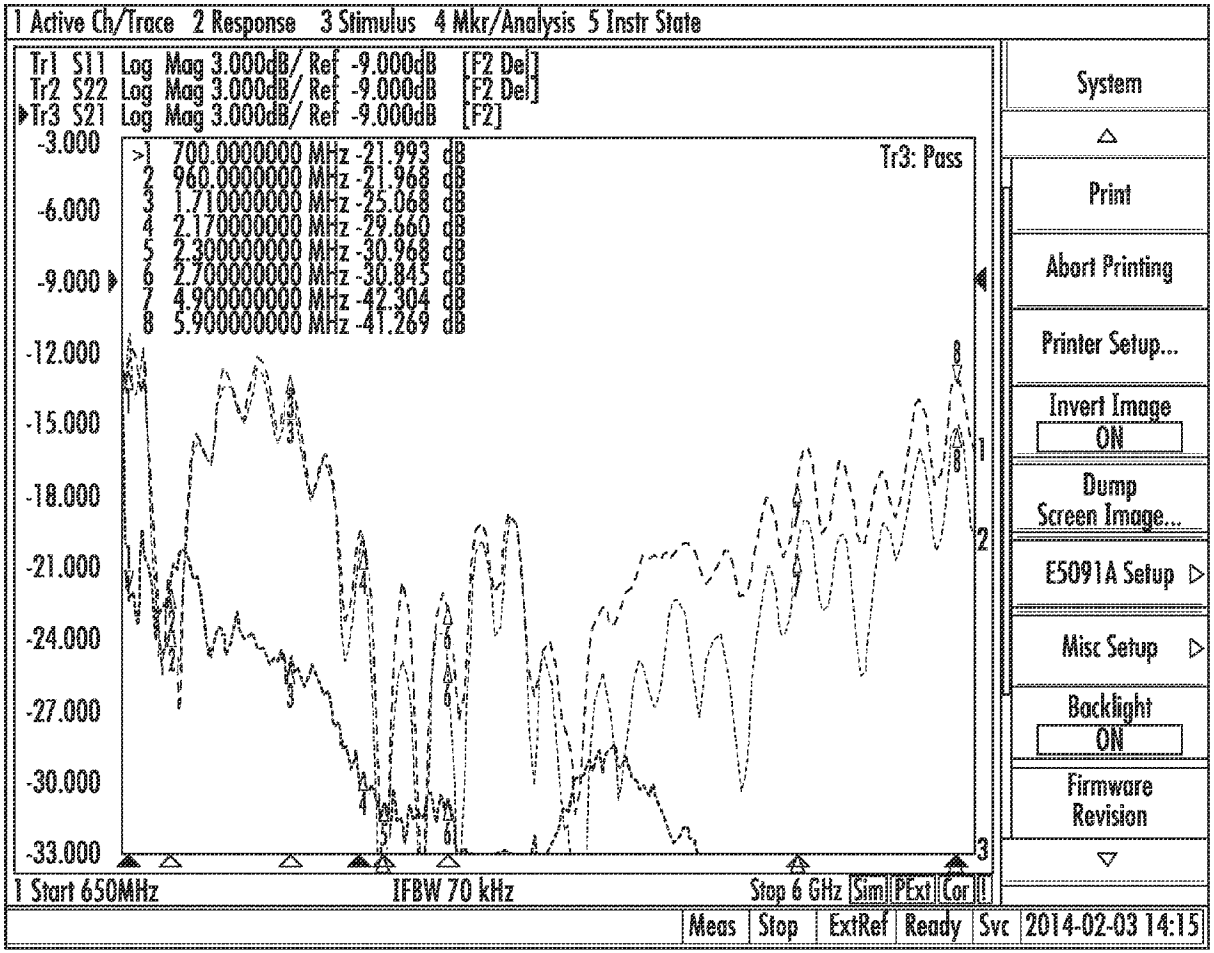
FIG. 2B is a chart illustrating, for example, the isolation performance of the low PIM antenna apparatus embodiment of FIG. 2A.

Referring now to FIG. 2B, S-parameter measurements for the low PIM antenna apparatus 200 illustrated in FIG. 2A is shown. Specifically, the isolation (S21) pattern for the low PIM antenna apparatus is improved via inclusion of the isolation ring 204. The isolation value at the lower band (i.e., 700 MHz) is around −20 dB. Furthermore, the isolation values throughout the operating range (i.e., up to 5.9 GHz) of the low PIM antenna apparatus is at or better than −20 dB. For example, in the embodiment illustrated in FIG. 2A, the isolation values (see FIG. 2B) at: (1) 960 MHz is −22 dB; (2) 1.71 GHz is −25 dB; (3) 2.17 GHz is −30 dB; (4) 2.3 GHz is −31 dB; (5) 2.7 GHz is −31 dB; (6) 4.9 GHz is −42 dB; and (7) 5.9 GHz is −41 dB.

Figure 2C:
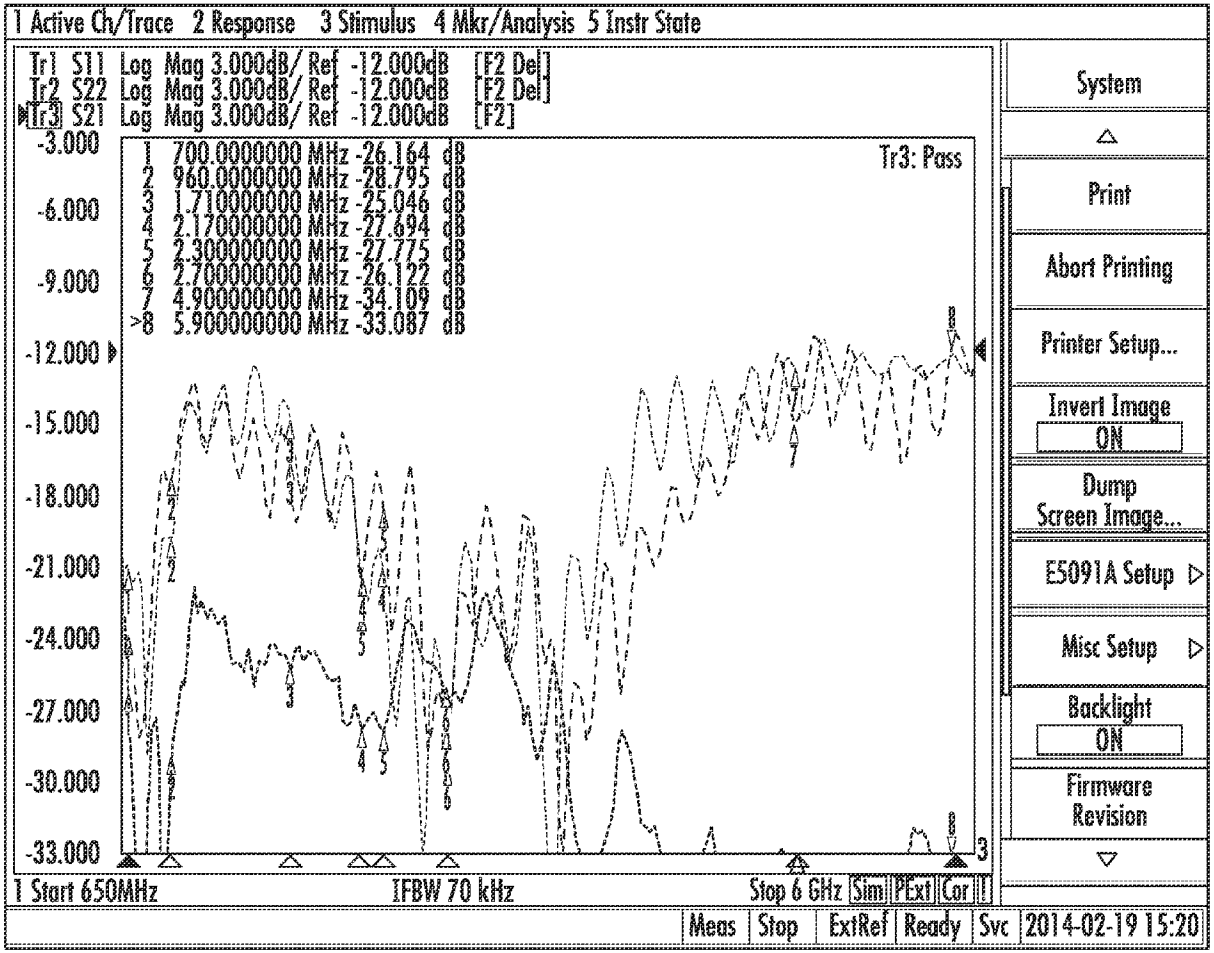
FIG. 2C is a chart illustrating, for example, the isolation performance of the low PIM antenna apparatus embodiment of FIG. 1.

Referring now to FIG. 2C, S-parameter measurements for the low PIM antenna apparatus 100 illustrated in, for example, FIG. 1 is shown. Specifically, the isolation (S21) pattern for the low PIM antenna apparatus is improved via inclusion of a pair of isolation rings 104. Specifically, the two isolation rings 104 that are attached to the ground plane 106 are disposed orthogonal with respect to each of the radiating elements 102 (e.g., MIMO antennas) illustrated in FIG. 1. The isolation value at the lower band (i.e., 700 MHz) is now around −26 dB. Furthermore, the isolation values throughout the operating range (i.e., up to 5.9 GHz) of the low PIM antenna apparatus is at or better than −25 dB. For example, in the embodiment illustrated in FIG. 1, the isolation value at: (1) 960 MHz is −28 dB; (2) 1.71 GHz is −25 dB; (3) 2.17 GHz is −28 dB; (4) 2.3 GHz is −28 dB; (5) 2.7 GHz is −26 dB; (6) 4.9 GHz is −34 dB; and (7) 5.9 GHz is −33 dB. Accordingly, it can be seen that the addition of an additional isolation ring (i.e. two (2) isolation rings) improves upon the isolation of the low PIM antenna apparatus at the lower end of the operational frequency by approximately 6 dB.

Furthermore, and as illustrated in FIG. 1, the isolation rings 104 themselves are aligned in parallel with respect to one another. The level of isolation is dependent upon the perimeter of inserted isolation ring (i.e., the length of the isolation ring). In the embodiment illustrated, the isolation rings 104 each have differing lengths with the longer wire being configured for the lower band of the antenna and the shorter wire being configured for the upper band. With an optimized perimeter for the inserted isolation rings 104, the isolation level is better than −25 dB over the entire operating frequency of the antenna. The isolation ring's resonance at certain frequencies prevents the direct coupling between the two radiating elements. Accordingly, the inserted isolation rings operate as isolators for the low PIM antenna apparatus. Moreover, while the embodiment of FIG. 1 is discussed in the context of two isolation rings 104 that each having a differing wire length, it is appreciated that these isolation rings may have identical or nearly identical lengths in other embodiments of the present disclosure.

Figure 3:
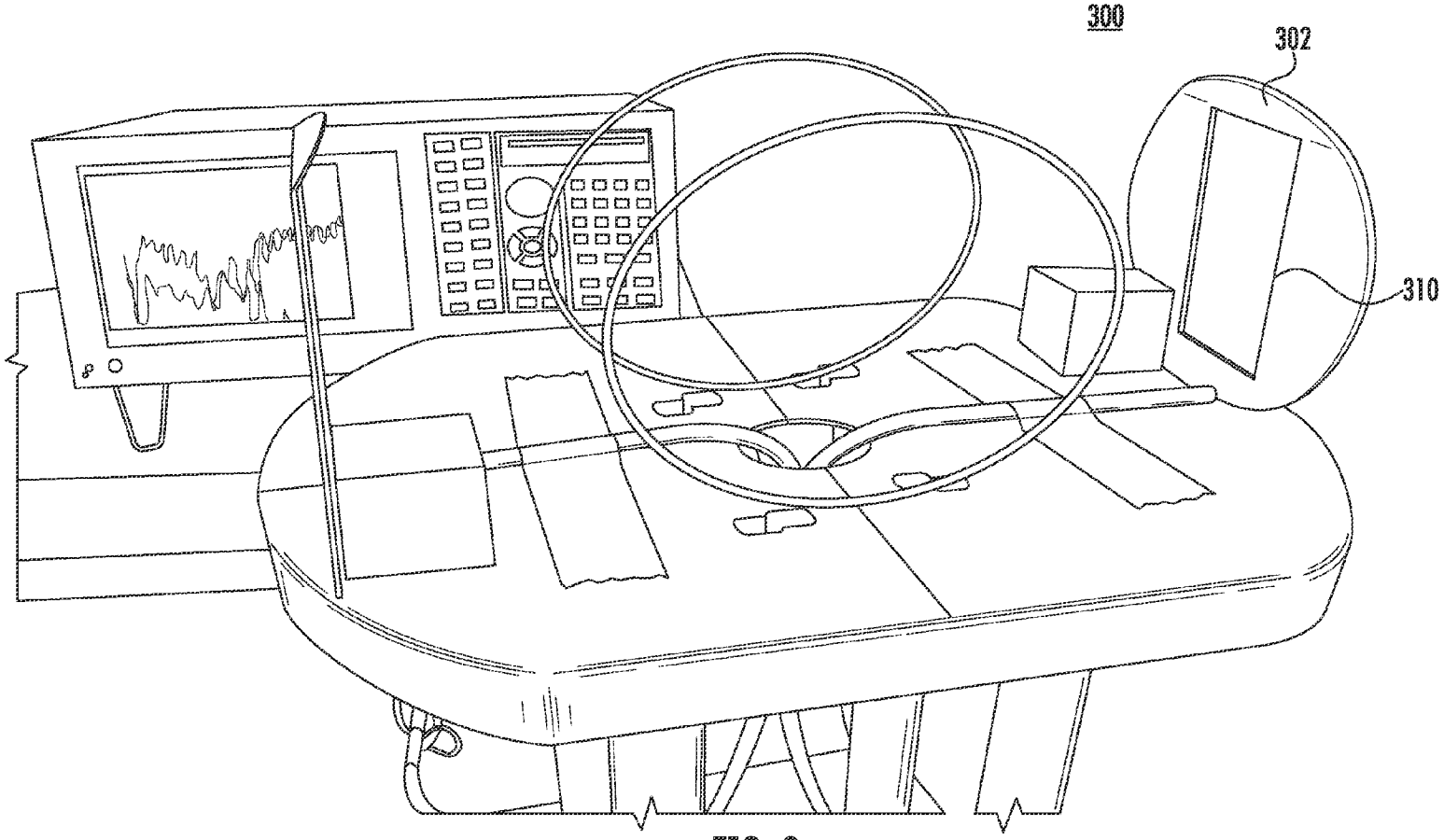
FIG. 3 is a perspective view of a third exemplary low PIM antenna apparatus, in accordance with the principles of the present disclosure.
Figure 4A:
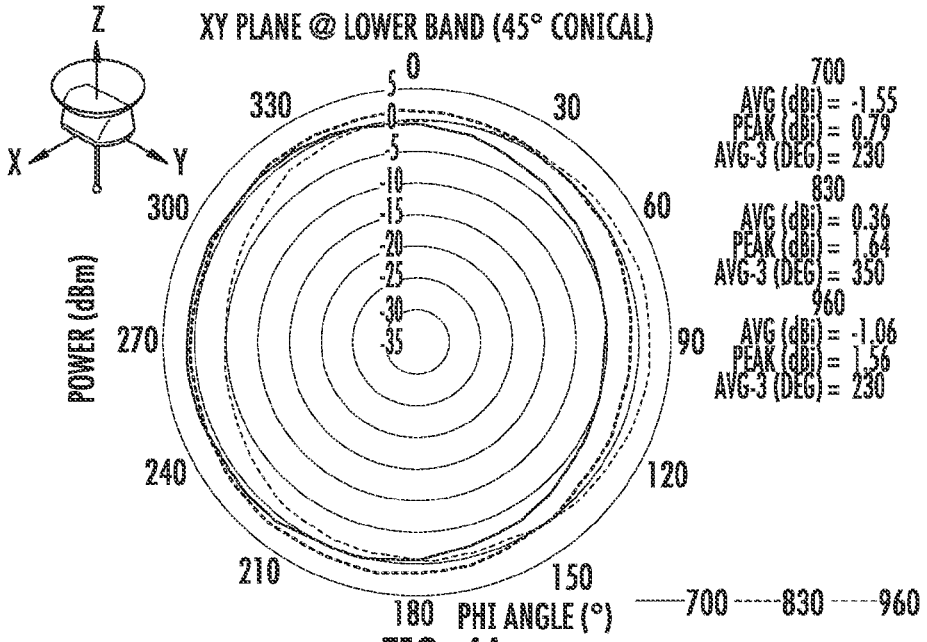
FIGS. 4A-4D are various radiation patterns in the XY plane as a function of operational frequency for the low PIM antenna apparatus of FIG. 1.
Figure 4B:
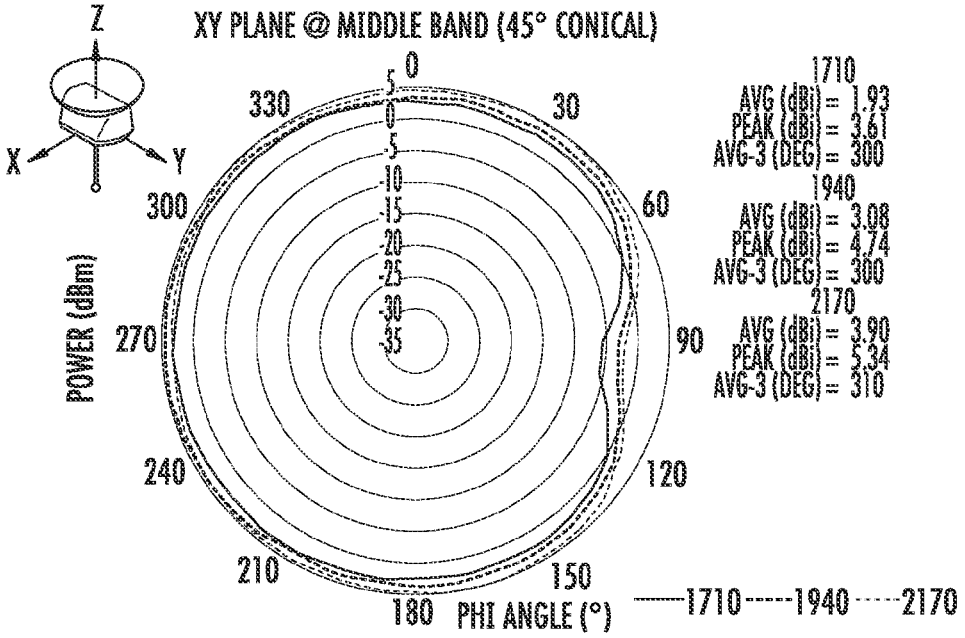
Figure 4C:
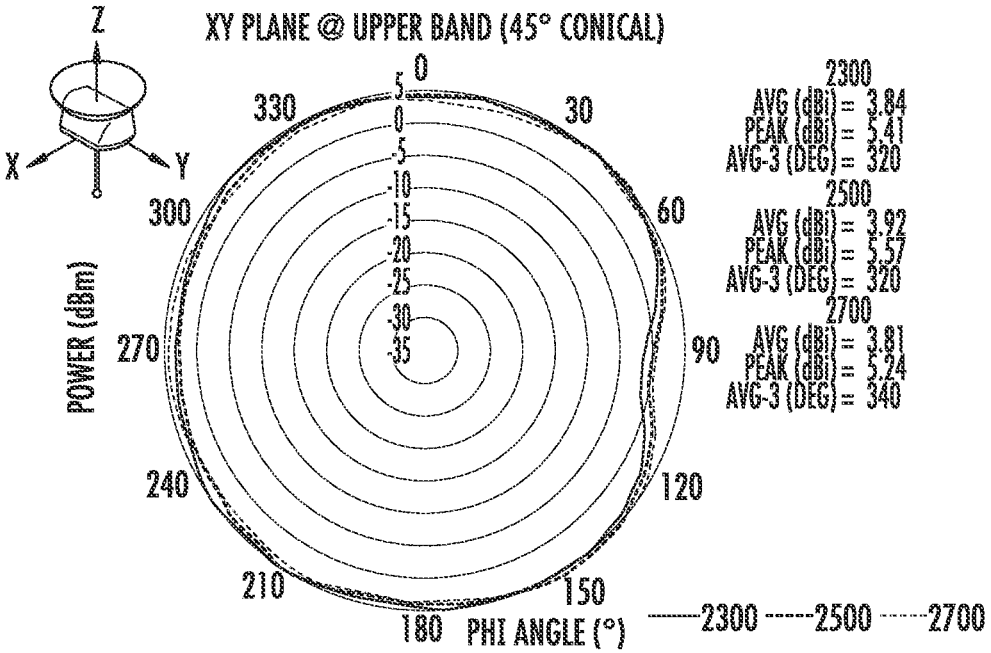
Figure 4D:
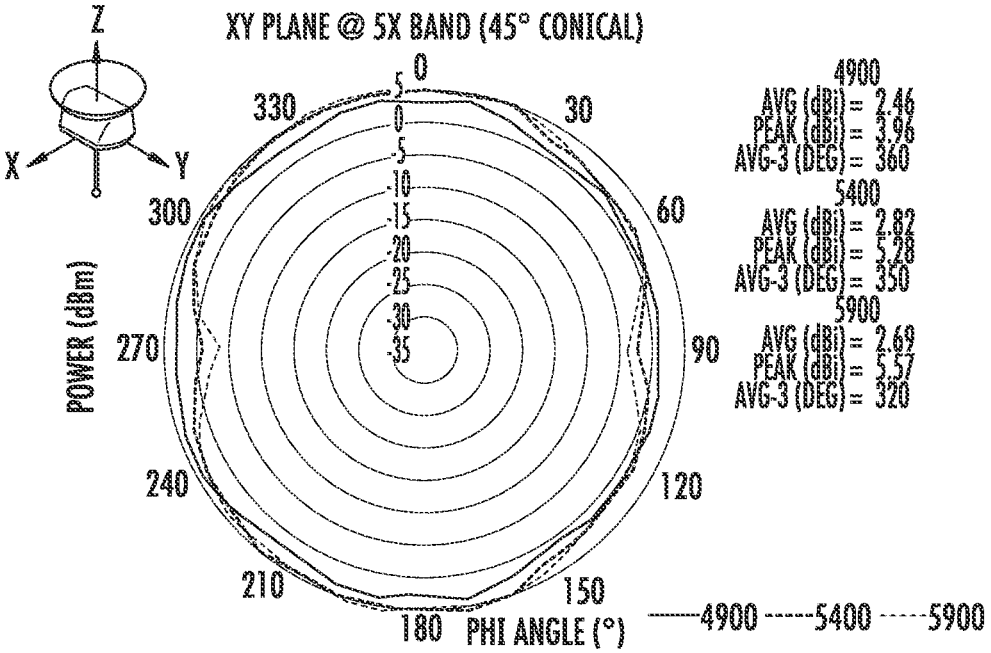

Referring now to FIG. 3, an alternative configuration for a low PIM antenna apparatus 300 manufactured in accordance with the principles of the present disclosure is shown. Specifically, the embodiment illustrated in FIG. 3, shows that each of the radiating elements 302 includes a rectangular slot 310 disposed therein. These rectangular slots are configured to enable more of the radiating signal to pass there through. In one exemplary embodiment, the rectangular slot is positioned in the center portion of the radiating element. Such a configuration enables the radiation patter of the low PIM antenna apparatus 300 to radiate in a more omni-directional shape. Specifically, the radiation energy is able to go through the rectangular slot, thereby minimizing the distortion in the radiation pattern for the antenna apparatus giving the antenna apparatus a more omni-directional radiation pattern. The improvement in radiation pattern is illustrated with respect to FIGS. 4A-4D and FIGS. 5A-5D. Specifically, FIGS. 4A-4D illustrates the radiation pattern for the solid radiating elements shown in, for example, FIG. 1. FIG. 4A illustrates the radiation pattern in the XY plane at the lower frequency band; FIG. 413 illustrates the radiation pattern in the XY plane at the middle frequency band; FIG. 4C illustrates the radiation pattern in the XY plane at the upper frequency band; and FIG. 4D illustrates the radiation pattern in the XY plane at the 4900-5900 MHz frequency band.

Figure 5A:
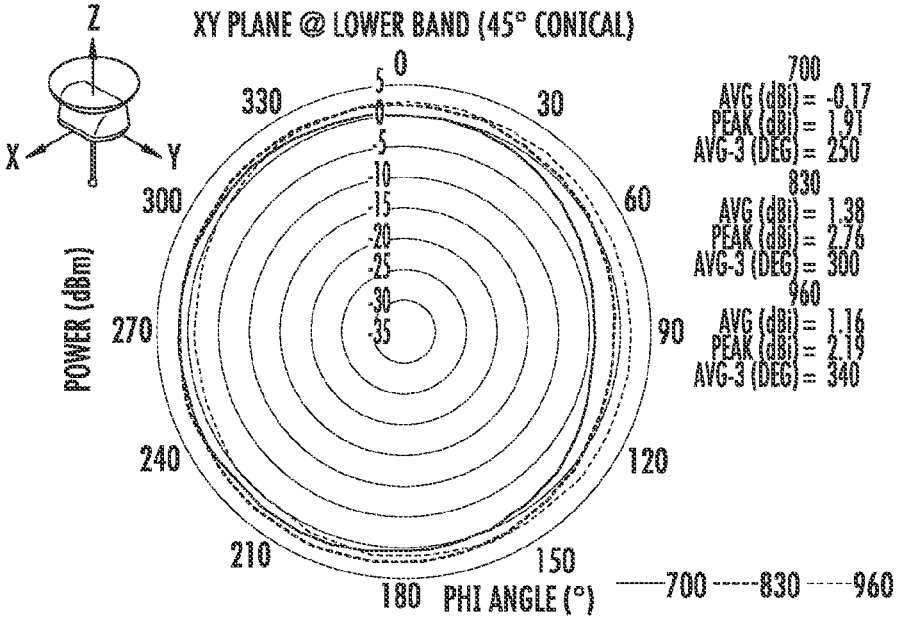
FIGS. 5A-5D are various radiation patterns in the XY plane as a function of operational frequency for the low PIM antenna apparatus of FIG. 3.
Figure 5B:
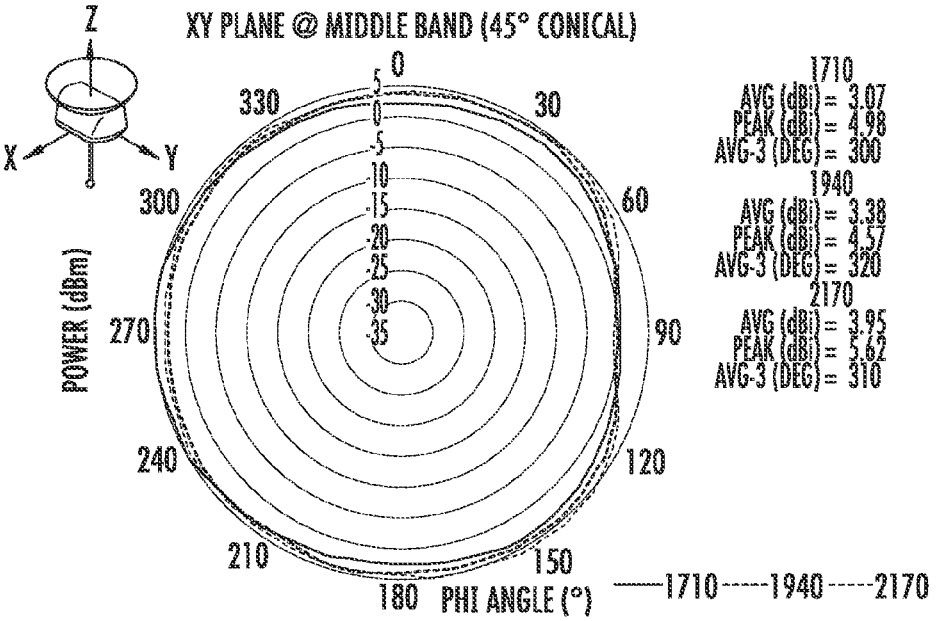
Figure 5C:
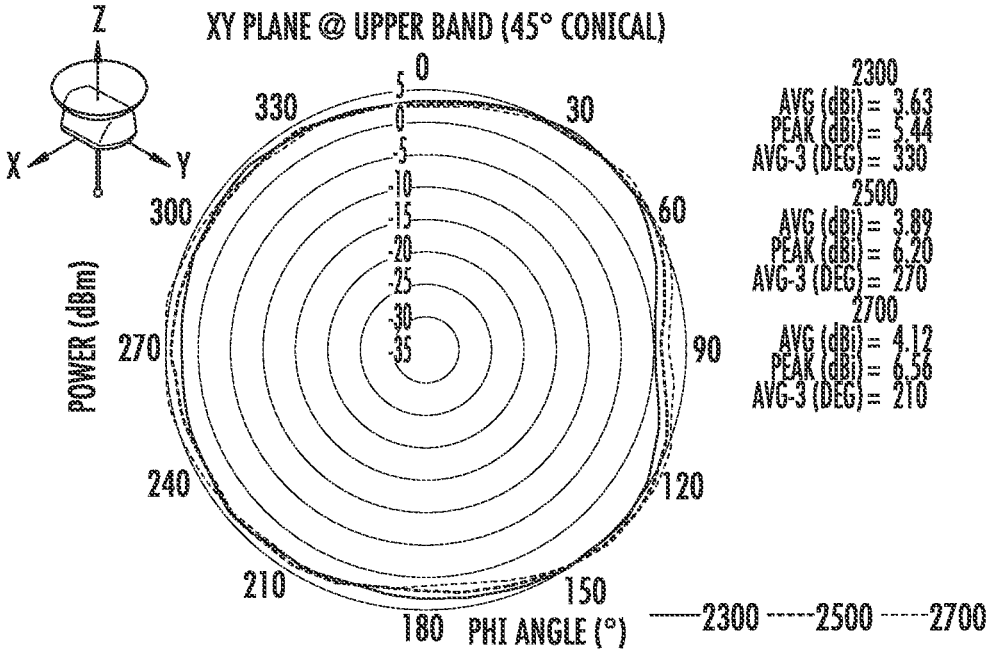
Figure 5D:
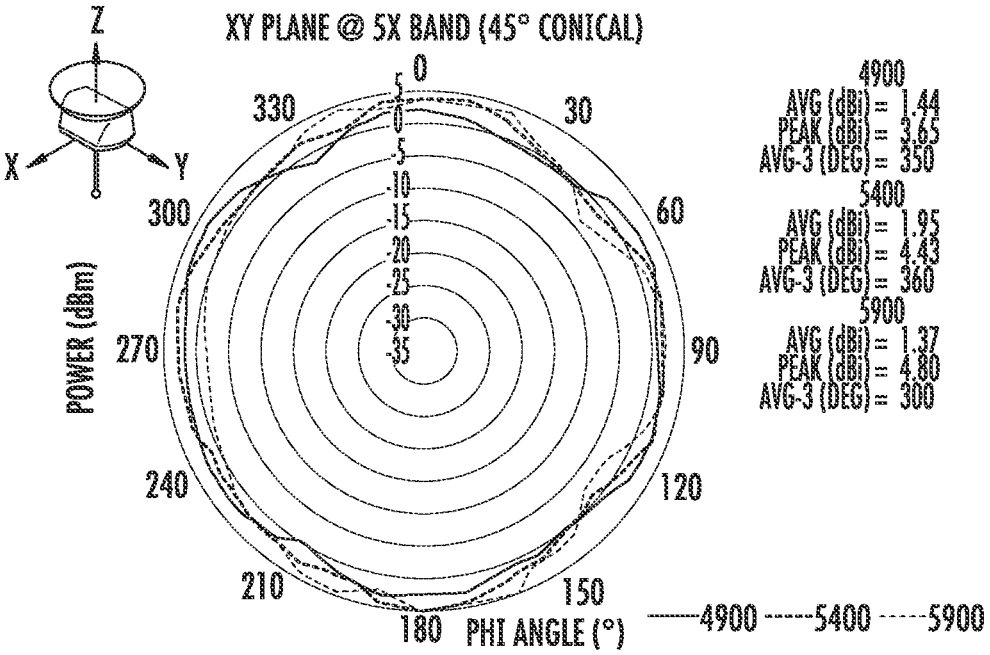

Contrast the radiation pattern of FIGS. 4A-4D with the radiation pattern illustrated in FIGS. 5A-5D. Specifically, the radiation patterns in FIGS. 5A-5D is illustrated for the radiating elements that include a rectangular slot as shown in, for example, FIG. 3. FIG. 5A illustrates the radiation pattern in the XY plane at the lower frequency band; FIG. 5B illustrates the radiation pattern in the XY plane at the middle frequency band; FIG. 5C illustrates the radiation pattern in the XY plane at the upper frequency band; and FIG. 5D illustrates the radiation pattern in the XY plane at the 5× frequency band. In other words, the radiation pattern for the embodiment of FIG. 3 exhibits a more omni-directional pattern than, for example, the low PIM antenna apparatus 100 illustrated in FIG. 1.

It will be recognized that while certain aspects of the present disclosure are described in terms of specific design examples, these descriptions are only illustrative of the broader methods of the disclosure, and may be modified as required by the particular design. Certain steps may be rendered unnecessary or optional under certain circumstances. Additionally, certain steps or functionality may be added to the disclosed embodiments, or the order of performance of two or more steps permuted. All such variations are considered to be encompassed within the present disclosure described and claimed herein.

While the above detailed description has shown, described, and pointed out novel features of the present disclosure as applied to various embodiments, it will be understood that various omissions, substitutions, and changes in the form and details of the device or process illustrated may be made by those skilled in the art without departing from the principles of the present disclosure. The foregoing description is of the best mode presently contemplated of carrying out the present disclosure. This description is in no way meant to be limiting, but rather should be taken as illustrative of the general principles of the present disclosure. The scope of the present disclosure should be determined with reference to the claims.

What is claimed is:

1. A low passive intermodulation (PIM) antenna apparatus, comprising:

a pair of planar radiating elements, each of the pair of planar radiating elements comprising a pair of larger surfaces that are separated by a smaller surface of the respective radiating element, a first larger surface of a first of the pair of radiating elements being parallel with a second larger surface of a second of the pair of radiating elements;

a ground plane upon which the pair of planar radiating elements are disposed, at least a majority portion of each of the pair of planar radiating elements being disposed on a same side of the ground plane; and one or more isolation rings disposed between the pair of planar radiating elements, the one or more isolation rings being oriented orthogonal with the first larger surface of the first of the pair of radiating elements and the second larger surface of the second of the pair of radiating elements, the one or more isolation rings being electrically coupled to the ground plane with a majority portion of the one or more isolation further being disposed on the same side of the ground plane;

wherein the pair of planar radiating elements and the one or more isolation rings are disposed substantially orthogonal with respect to a top surface of the ground plane; and wherein the disposition of the one or more isolation rings between the pair of radiating elements improves upon an isolation measure between the pair of radiating elements.

2. The low PIM antenna apparatus of claim 1, wherein the one or more isolation rings comprises a plurality of isolation rings.

3. The low PIM antenna apparatus of claim 2, wherein at least a portion of the plurality of isolation rings has a differing wire length.

4. The low PIM antenna apparatus of claim 3, wherein the differing wire length is configured for a plurality of operating bands for the low PIM antenna apparatus.

5. The low PIM antenna apparatus of claim 1, wherein at least one of the pair of planar radiating elements has an aperture extending there through, the aperture configured to enable the low PIM antenna apparatus to radiate in a more omni-directional shape.

6. The low PIM antenna apparatus of claim 1, wherein the ground plane is manufactured from a non-ferromagnetic material.

7. The low PIM antenna apparatus of claim 6, wherein the ground plane consists of a non-ferromagnetic plating.

8. The low PIM antenna apparatus of claim 7, wherein the non-ferromagnetic plating is only provided at one or more select locations, the one or more select locations including portions whereby the one or more isolation rings are attached thereto.

9. The low PIM antenna apparatus of claim 6, wherein the ground plane is formed so as to have an electrical length that is greater than a diameter for the ground plane.

10. The low PIM antenna apparatus of claim 1, further comprising:

a stem configured for mounting the low PIM antenna apparatus to an external surface; and a low PIM connector assembly, at least a portion of the low PIM connector assembly being routed through the stem.

11. The low PIM antenna apparatus of claim 10, wherein the stem further comprises a threaded stem and the low PIM antenna apparatus further comprises a nut configured for use with the threaded stem in order to enable the mounting of the low PIM antenna apparatus to the external surface.

12. The low PIM antenna apparatus of claim 11, wherein the threaded stem, the ground plane and the nut are configured to provide for strain relief for the low PIM connector assembly.

13. The low PIM antenna apparatus of claim 11, wherein the low PIM antenna apparatus is configured to reduce and/or eliminate nonlinearity over time via the use of similar materials throughout the low PIM antenna apparatus.

14. The low PIM antenna apparatus of claim 1, further comprising a radome cover, the radome cover configured to encase at least the pair of the planar radiating elements and the one or more isolation rings.

15. The low PIM antenna apparatus of claim 14, wherein the radome cover further comprises one or more isolation ring retention features, the one or more isolation ring retention features being configured to maintain the one or more isolation rings in a desired orientation.

16. The low PIM antenna apparatus of claim 15, wherein the desired orientation comprises an orthogonal orientation with respect to the pair of planar radiating elements.

17. The low PIM antenna apparatus of claim 15, wherein the one or more isolation rings comprises a plurality of isolation rings.

18. The low PIM antenna apparatus of claim 17, wherein at least a portion of the plurality of isolation rings has a differing wire length.

19. The low PIM antenna apparatus of claim 18, wherein the differing wire length is configured for a plurality of operating bands for the low PIM antenna apparatus.

20. The low PIM antenna apparatus of claim 19, wherein the low PIM antenna apparatus is configured to reduce and/or eliminate nonlinearity over time via the use of similar materials throughout the low PIM antenna apparatus.

* * * * *